US009199456B2

(12) United States Patent
Domae

(10) Patent No.: US 9,199,456 B2
(45) Date of Patent: Dec. 1, 2015

(54) LIQUID JET HEAD, LIQUID JET APPARATUS AND METHOD OF MANUFACTURING LIQUID JET HEAD

(71) Applicant: SII PRINTEK INC., Chiba-shi, Chiba (JP)

(72) Inventor: Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/327,029

(22) Filed: Jul. 9, 2014

(65) Prior Publication Data

US 2015/0022594 A1 Jan. 22, 2015

(30) Foreign Application Priority Data

Jul. 18, 2013 (JP) ..... 2013-149081

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/1433* (2013.01); *B41J 2/14209* (2013.01); *B41J 2/1609* (2013.01); *B41J 2/1623* (2013.01); *B41J 2/1631* (2013.01); *B41J 2/1632* (2013.01); *B41J 2202/12* (2013.01)

(58) Field of Classification Search
CPC ..... B41J 2/14201; B41J 2/14209; B41J 2/14274; B41J 2002/14266; B41J 2002/14306
See application file for complete search history.

(56) References Cited

U.S. PATENT DOCUMENTS

| | | | | |
|---|---|---|---|---|
| 5,463,414 | A * | 10/1995 | Temple et al. | 347/68 |
| 5,657,063 | A * | 8/1997 | Takahashi | 347/69 |
| 6,572,221 | B1 | 6/2003 | Harvey et al. | 347/68 |
| 2013/0002769 | A1 * | 1/2013 | Koseki | 347/71 |

FOREIGN PATENT DOCUMENTS

| | | |
|---|---|---|
| EP | 2540504 | 1/2013 |
| JP | 07205422 | 8/1995 |
| JP | 08258261 | 10/1996 |
| JP | 10086369 | 4/1998 |
| JP | 11314362 | 11/1999 |
| JP | 2009500209 | 1/2009 |

OTHER PUBLICATIONS

EPO Search Report mailed Nov. 14, 2014 issued in EP Patent Appln. No. EP 14 17 6805.

* cited by examiner

*Primary Examiner* — Geoffrey Mruk
(74) *Attorney, Agent, or Firm* — Adams & Wilks

(57) ABSTRACT

A liquid jet head includes a piezoelectric body substrate on which ejection grooves penetrating from an upper surface to a lower surface and non-ejection grooves open on the lower surface are alternately arranged in a reference direction and form a groove row, a cover plate that includes a liquid chamber communicating with the ejection grooves is bonded on the upper surface of the piezoelectric body substrate, and a nozzle plate that includes nozzles communicating with the ejection grooves is bonded on the lower surface of the piezoelectric body substrate. Common drive electrodes are installed on side surfaces of the ejection grooves, which are on the lower-surface side from nearly ½ the depth of the ejection grooves, and individual drive electrodes are installed on side surfaces of the non-ejection grooves, which are on the lower-surface side from nearly ½ the depth of the non-ejection grooves.

20 Claims, 15 Drawing Sheets

(S8)

(S9-1)

(S9-2)

(S9-3)

(S4-1)

(S4-2)

(S4-3)

LIQUID JET HEAD, LIQUID JET APPARATUS AND METHOD OF MANUFACTURING LIQUID JET HEAD

BACKGROUND

1. Technical Field

The present invention relates to a liquid jet head that jets droplets onto a recording medium or onto an element substrate, a liquid jet apparatus, and a method of manufacturing a liquid jet head.

2. Related Art

Recently, there has been used a liquid jet head of an ink jet system that ejects ink droplets onto a recording paper or the like to record characters or figures thereon, or ejects a liquid material onto the surface of an element substrate to form a functional thin film thereon. The method leads liquid such as ink or a liquid material to a channel through a supply tube from a liquid tank and applies pressure to the liquid with which the channel is filled to eject the liquid as droplets from a nozzle communicating with the channel. While the droplets are ejected, the liquid jet head or the recording medium is moved to record characters or figures, or a functional thin film having a predetermined shape is formed.

JP 7-205422 A describes an edge shoot type liquid jet apparatus. FIG. 16 is an exploded perspective view of a head portion of a liquid jet apparatus 100. The liquid jet head includes a piezoelectric ceramics plate 102 on which a plurality of grooves are formed, a cover plate 110 bonded on the surface of the piezoelectric ceramics plate 102 and configured to supply liquid to the grooves, and a nozzle plate 124 adhered to an edge surface 116 of the piezoelectric ceramics plate 102 and configured to eject the droplets from nozzles 122 communicating with the grooves.

Shallow grooves 103 open on the front side 117 and deep grooves 111 open on the reverse side 118 are alternately formed on the piezoelectric ceramics plate 102. Each of the shallow grooves 103 forms an ink room 104 which is filled with liquid. A metal electrode 108 is formed on the whole surface of the side of the shallow groove 103. The opening width of each of the deep grooves 111 is extended on the reverse side 118 side deeper than the depth of the shallow groove 103. A metal electrode 109 is formed on the side surface of the deep groove 111 on the reverse side 118 side deeper than half the depth of the shallow groove 103. The metal electrodes 109 of the deep grooves 111 are electrically separate from each other. The piezoelectric ceramics plate 102 is polarized in the direction of an arrow 105.

The cover plate 110 includes a liquid introduction port 114 configured to introduce liquid, and a manifold 101 configured to supply the liquid to the shallow grooves 103. The cover plate 110 includes a metal electrode 119, which is electrically connected to the metal electrode 108 of the shallow grooves 103, on the surface on the piezoelectric ceramics plate 102 side. The nozzle plate 124 is adhered to the edge surface 116 of the piezoelectric ceramics plate 102 while the nozzles 122 communicate with the shallow grooves. Supplying a drive signal between the metal electrode 108 on the side surface of the shallow groove 103 and the metal electrode 109 on the side surface of the deep groove 111 deforms the sidewall dividing the shallow groove 103 and the deep groove 111 and generate a pressure wave in the liquid with which the shallow groove 103 is filled. This ejects the droplets from the nozzle 122.

JP 2009-500209 W, JP 8-258261 A, JP 11-314362 A, and JP 10-86369 A describe, as well as JP 7-205422 A, a liquid jet head including grooves that are channels alternately open on the front side and the reverse side of the piezoelectric body substrate. JP 2009-500209 W, JP 8-258261 A, JP 11-314362 A, and JP 10-86369 A describe an edge shoot type liquid jet head that includes a channel row arranged in the direction perpendicular to the longitudinal direction of each channel and that ejects droplets from an longitudinal edge portion of an ejection channel.

In the liquid jet head described in JP 7-205422 A, the shallow grooves 103 are formed on the front side 117 of the piezoelectric ceramics plate 102 and the deep grooves 111 are formed on the reverse side 118 alternately with the shallow grooves 103. The shallow grooves 103 are not open on the reverse side 118 while the deep grooves 111 are not open on the front side. Further, the metal electrode 108 is formed on the shallow groove 103 and the metal electrode 109 is formed on the deep groove 111 while they are electrically separate from each other. It is difficult to form the metal electrode 108 of the shallow groove 103 and the metal electrode 109 of the deep groove 111 simultaneously. In JP 7-205422 A, metal is deposited in an oblique direction slanted from the vertical direction of the reverse side 118 using a sputtering method such that the metal electrode 109 is formed to about half the depth of the shallow groove 103 from the reverse side 118. The metal electrode 108 of the shallow groove 103 is formed in a different process.

In JP 2009-500209 W, JP 8-258261 A, JP 11-314362 A, and JP 10-86369 A, the grooves are alternately formed on the front side and reverse side of the piezoelectric body substrate, similarly. In the area in which the grooves are formed, the grooves on the front side are not open on the reverse side while the deep grooves on the reverse side are not open on the front side. The electrode formed on the groove on the front side and the electrode formed on the groove on the reverse side are electrically separate from each other. Thus, it is difficult to form the electrode on the groove on the front side and the electrode on the groove on the reverse side simultaneously. In the liquid jet head described in JP 2009-500209 W, both of ejection channels and non-ejection channels are filled with liquid. Thus, the liquid contacts the surfaces of the electrodes on both of the channels. Accordingly, it is necessary to install a protection film or the like on the surface of the electrode when a conductive ejection liquid is used. This complicates and elongates the manufacturing steps.

SUMMARY

The liquid jet head according to the present invention includes: a piezoelectric body substrate on which ejection grooves penetrating from an upper surface to a lower surface and non-ejection grooves open on the lower surface are alternately arranged in a reference direction and form a groove row; a cover plate that includes a liquid chamber communicating with the ejection grooves and is bonded on the upper surface of the piezoelectric body substrate; and a nozzle plate that includes nozzles communicating with the ejection grooves and is bonded on the lower surface of the piezoelectric body substrate; wherein common drive electrodes are installed on side surfaces of the ejection grooves, which are lower than nearly ½ of a thickness of the piezoelectric body substrate, and individual drive electrodes are installed on side surfaces of the non-ejection grooves, which are lower than nearly ½ of a thickness of the piezoelectric body substrate.

Furthermore, common terminals electrically connected to the common drive electrodes and individual terminals electrically connected to the individual drive electrodes are installed on the lower surface of the piezoelectric body substrate.

The individual terminal electrically connects two individual drive electrodes installed on ejection-groove-side side surfaces of the two non-ejection grooves holding the ejection groove to each other.

The liquid jet head according to the present invention further includes: a flexible circuit board including a wiring pattern, wherein the flexible circuit board is connected to the lower surface of the piezoelectric body substrate while the wiring pattern is electrically connected to the common terminals and the individual terminals.

A groove-direction width of the common drive electrode is nearly equal to or narrower than a groove-direction width of an opening portion at which the ejection groove is open on the lower surface of the piezoelectric body substrate.

At least one of groove-direction edge portions of an opening portion at which the non-ejection groove is open on the lower surface of the piezoelectric body substrate is extended to a side surface of the piezoelectric body substrate.

The non-ejection groove is open at a region that is on the upper surface of the piezoelectric body substrate and that is except for a region at which the liquid chamber is formed.

The piezoelectric body substrate includes a plurality of the groove rows arranged in parallel in a reference direction, and another-groove-row-side edge portion of the ejection groove included in a one groove row among the groove rows next to each other and a one-groove-row-side edge portion of the non-ejection groove included in another groove row are separate from each other while overlapping with each other in a thickness direction of the piezoelectric body substrate.

A liquid jet apparatus according to the present invention includes: one of the above-mentioned liquid jet heads; a movement mechanism configured to relatively move the liquid jet head and a recording medium; a liquid supply tube configured to supply liquid to the liquid jet head; and a liquid tank configured to supply the liquid to the liquid supply tube.

A method of manufacturing a liquid jet head according to the present invention, the method includes: an ejection groove forming step of forming a plurality of ejection grooves by cutting a piezoelectric body substrate from an upper surface of the piezoelectric body substrate; a non-ejection groove forming step of forming a plurality of non-ejection grooves in parallel to a groove direction of the ejection grooves by cutting the piezoelectric body substrate from a lower surface of the piezoelectric body substrate; a cover plate bonding step of bonding a cover plate on which a liquid chamber is formed onto the upper surface of the piezoelectric body substrate while allowing the liquid chamber to communicate with the ejection grooves; and a conductive material depositing step of depositing a conductive material on the piezoelectric body substrate from the lower surface of the piezoelectric body substrate.

The method further includes: a photopolymer film forming step of installing a photopolymer film on the lower surface of the piezoelectric body substrate before the conductive material depositing step.

The method further includes: a piezoelectric body substrate grinding step of grinding the piezoelectric body substrate to a predetermined thickness after the ejection groove forming step.

The method further includes: a nozzle plate bonding step of allowing nozzles formed on a nozzle plate to communicate with the ejection grooves by bonding the nozzle plate onto the lower surface of the piezoelectric body substrate.

In the ejection groove forming step and the non-ejection groove forming step, a plurality of groove rows in which the ejection grooves and the non-ejection grooves are alternately arranged in a reference direction is formed next to each other, and another-groove-row-side edge portion of the ejection groove included in a one groove row among the groove rows next to each other and a one-groove-row-side edge portion of the non-ejection groove included in another groove row are separate from each other while overlapping with each other in a thickness direction of the piezoelectric body substrate.

In the conductive material depositing step, a mask is installed on the lower surface of the piezoelectric body substrate so as to cover another-groove-row-side edge portion of the ejection groove included in a one groove row among the groove rows next to each other and a one-groove-row-side edge portion of the non-ejection groove included in another groove row.

The method further includes: an insulating material depositing step of depositing an insulating material on the piezoelectric body substrate from the lower surface of the piezoelectric body substrate while the ejection groove penetrates from the upper surface to the lower surface of the piezoelectric body substrate and, before the conductive material depositing step, a part of an opening portion open on the lower surface of the piezoelectric body substrate is covered.

The liquid jet head according to the present invention includes a piezoelectric body substrate on which ejection grooves penetrating from an upper surface to a lower surface and non-ejection grooves open on the lower surface are alternately arranged in a reference direction and form a groove row, a cover plate that includes a liquid chamber communicating with the ejection grooves and is bonded on the upper surface of the piezoelectric body substrate, a nozzle plate that includes nozzles communicating with the ejection grooves and is bonded on the lower surface of the piezoelectric body substrate. Common drive electrodes are installed on side surfaces of the ejection grooves, which are lower than nearly ½ of a thickness of the piezoelectric body substrate, and individual drive electrodes are installed on side surfaces of the non-ejection grooves, which are lower than nearly ½ of a thickness of the piezoelectric body substrate. This can simply form the common drive electrodes and the individual drive electrodes that do not contact liquid.

BRIEF DESCRIPTION OF THE DRAWINGS

FIGS. 7S1 to 7S4 are explanatory views of the method of manufacturing the liquid jet head according to the third embodiment of the present invention;

FIGS. 9S1, 9S2 and 9S5 to 957 are schematic cross-sectional views for describing the steps of the method of manufacturing the liquid jet head according to the fourth embodiment of the present invention;

FIGS. 11S3-1 and 11S3-2 are views for describing the steps of the method of manufacturing the liquid jet head according to the fourth embodiment of the present invention;

FIGS. 12S9-1 to 12S9-3 are views for describing the steps of the method of manufacturing the liquid jet head according to the fourth embodiment of the present invention;

FIGS. 13S4-1 to 13S4-3 are views for describing the steps of the method of manufacturing the liquid jet head according to the fourth embodiment of the present invention;

FIGS. 14S10 and 14S11 are views for describing the steps of the method of manufacturing the liquid jet head according to the fourth embodiment of the present invention;

DETAILED DESCRIPTION (First Embodiment)

Figure 1:
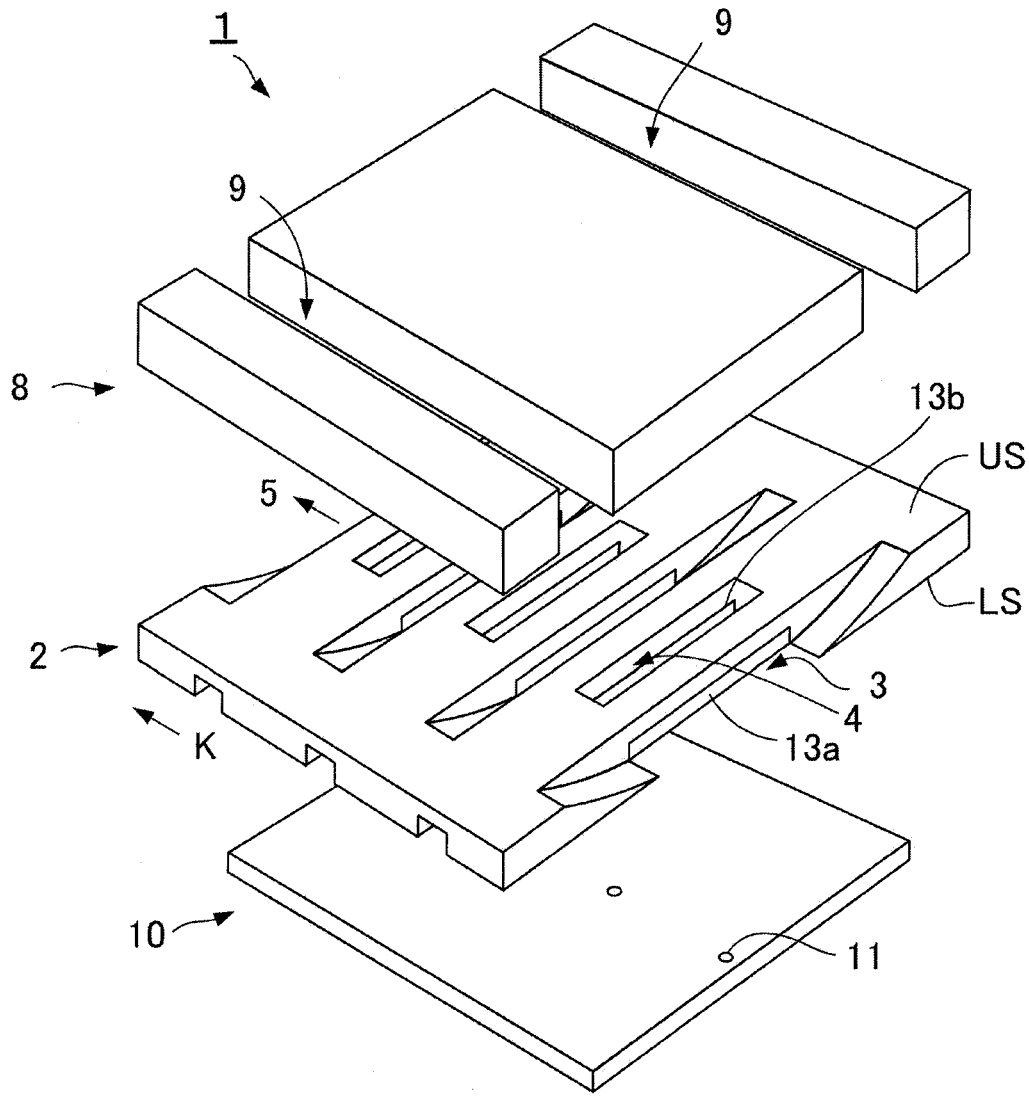
FIG. 1 is a schematic exploded perspective view of a liquid jet head according to a first embodiment of the present invention.
Figure 2A:
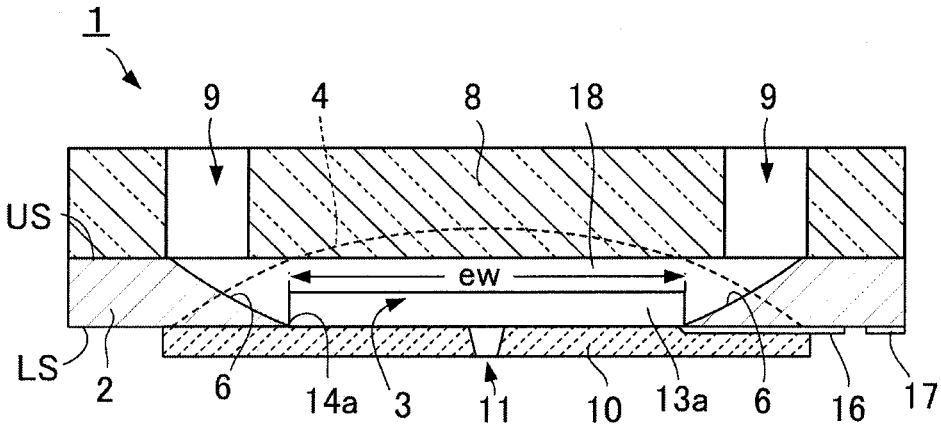
FIGS. 2A to 2C are explanatory drawings of the liquid jet head according to the first embodiment of the present invention.
Figure 2B:
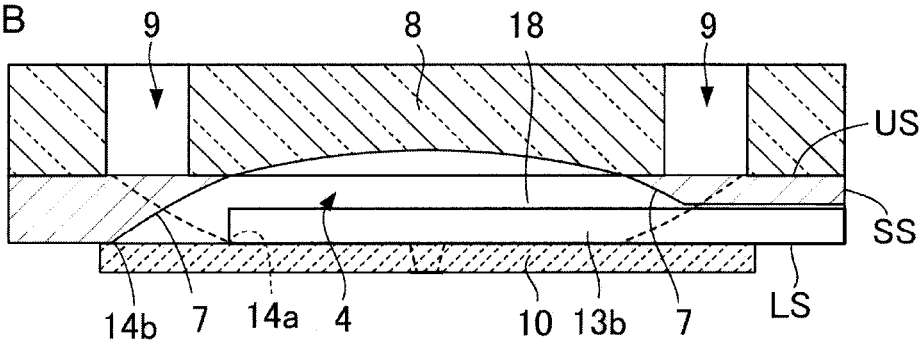
Figure 2C:
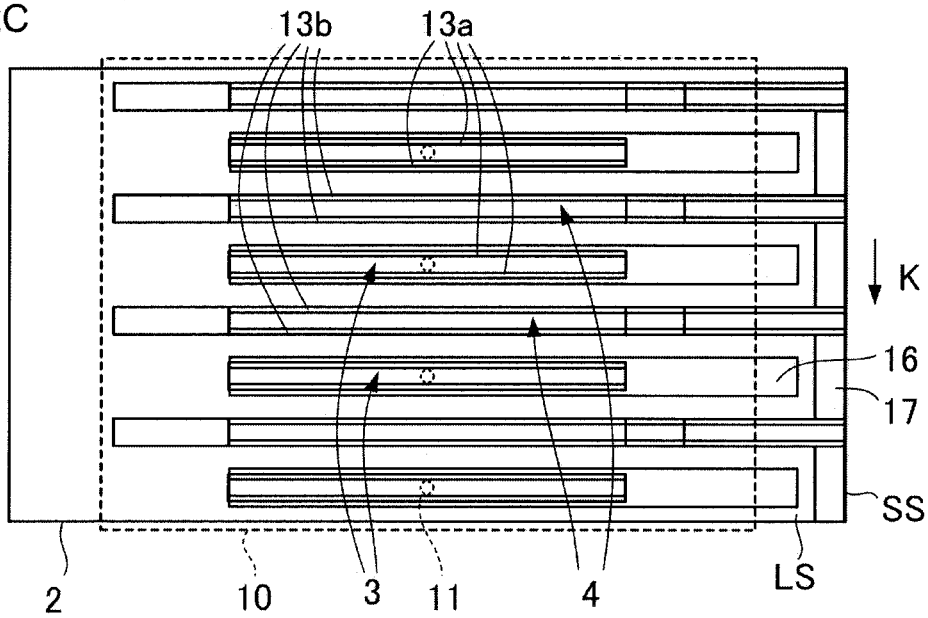

FIG. 1 is a schematic exploded perspective view of a liquid jet head 1 according to a first embodiment of the present invention. FIGS. 2A to 2C are explanatory drawings of the liquid jet head 1 according to the first embodiment of the present invention. FIG. 2A is a schematic cross-sectional view taken along the direction of an ejection groove 3. FIG. 2B is a schematic cross-sectional view of a non-ejection groove 4. FIG. 2C is a schematic plan view of a piezoelectric body substrate 2 viewed from a nozzle plate 10 side.

As described in FIG. 1, the liquid jet head 1 includes a piezoelectric body substrate 2, a cover plate 8 bonded on an upper surface US of the piezoelectric body substrate 2, and a the nozzle plate 10 bonded on a lower surface LS of the piezoelectric body substrate 2. The piezoelectric body substrate 2 includes ejection grooves 3 penetrating from the upper surface US to the lower surface LS, and non-ejection grooves 4 open on the lower surface LS which are alternately arranged in a reference direction K and form a groove row 5. Note that the non-ejection grooves 4 penetrate from the upper surface US to lower surface LS of the piezoelectric body substrate 2. The cover plate 8 includes liquid chambers 9 communicating with the ejection grooves 3. The nozzle plate 10 includes nozzles 11 communicating with the ejection grooves 3. In that case, a common drive electrode 13*a* is installed on the side surface of each ejection groove 3, which is on the lower-surface-LS side lower than nearly ½ of the thickness of the piezoelectric body substrate 2, i.e., lower than nearly ½ of the depth of the ejection grooves 3 whose depth is the same as the thickness of the piezoelectric body substrate 2. An individual drive electrode 13*b* is installed on the side surface of each non-ejection groove 4, which is on the lower-surface-LS side lower than nearly ½ of the thickness of the piezoelectric body substrate 2, i.e., lower than nearly ½ of the depth of the non-ejection grooves 4 whose depth is the same as the thickness of the piezoelectric body substrate 2.

As described above, the ejection grooves 3 penetrate from the upper surface US to the lower surface LS. The non-ejection grooves 4 are open on the lower surface LS. The common drive electrodes 13*a* and the individual drive electrodes 13*b* are formed on the lower-surface-LS side lower than nearly ½ of the thickness of the piezoelectric body substrate 2. This can form the common drive electrodes 13*a* and the individual drive electrodes 13*b* simultaneously in the same process as to be described in detail in the embodiments of the manufacturing method below. Furthermore, this can easily connect common terminals or individual terminals formed on the lower surface LS of the piezoelectric body substrate 2 to the common drive electrodes 13*a* and the individual drive electrodes 13*b*.

The piezoelectric body substrate 2 can be made of lead zirconate titanate (PZT) ceramics. The piezoelectric body substrate 2 is polarized in the normal direction of the upper surface US or lower surface LS. Each groove can be cut and formed using a dicing blade (also referred to as a diamond blade) with cutting abrasive grain such as diamond on the outer circumference of the disk. The ejection groove 3 can be formed by cutting the piezoelectric body substrate 2 from the upper surface US toward the lower surface LS. The non-ejection groove 4 can be formed by cutting the piezoelectric body substrate 2 from the lower surface LS toward the upper surface US. The cover plate 8 is preferably made of a material of which thermal expansion coefficient is approximation to the piezoelectric body substrate 2. For example, PZT ceramics or a machinable ceramics material can be used. For example, a polyimide film can be used as the nozzle plate 10.

The liquid jet head 1 will specifically be described with reference to FIGS. 2A to 2C. As illustrated in FIG. 2A, the ejection groove 3 penetrates from the upper surface US to the lower surface LS. The ejection groove 3 is cut using the dicing blade such that the external form of the dicing blade is transcribed on both edge portions of the ejection groove 3. This forms an inclined surface (inclined portion) 6 cut upward from the lower surface LS to the upper surface US, i.e., the inclined surface (inclined portion) 6 is inclined outward from the lower surface LS to the upper surface US. The common drive electrodes 13*a* are installed on both side surfaces of the ejection groove 3, which is on the lower-surface-LS side lower than nearly ½ of the thickness of the piezoelectric body substrate 2. A groove-direction width ew of the common drive electrode 13*a* is nearly equal to or narrower than the groove-direction width of an opening portion 14*a* in which the ejection groove 3 is open on the lower surface LS of the piezoelectric body substrate 2. In other word, the common drive electrode 13*a* is formed by depositing a metal material from the lower-surface-LS side through the opening portion 14*a*. Thus, the common drive electrode 13*a* is installed at a position at which the opening portion 14*a* is open and the groove-direction width does not exceed the groove-direction width of the opening portion 14*a*.

The common drive electrode 13*a* and the individual drive electrode 13*b* are installed on the side surfaces of a sidewall dividing the ejection groove 3 and the non-ejection groove 4. At least, the upper edge surface of the sidewall 18, which is located in the groove direction in which the common drive electrode 13*a* is installed, is preferably bonded to the cover plate 8 and fixed. Fixing the upper edge of the sidewall on which the common drive electrode 13*a* is installed can efficiently induce a pressure wave in the liquid in the ejection groove 3. Note that using a dicing blade to cut the ejection groove 3 is not an essential requirement for the present invention. Accordingly, both of the edge portions of the ejection groove 3 can have vertical surfaces.

One of the two liquid chambers 9 formed on the cover plate 8 communicates with an edge portion of the ejection groove 3 while the other liquid chamber 9 communicates with the other edge portion of the ejection groove 3. This enables the liquid flowing in from one of the liquid chambers 9 to flow out from the other liquid chamber 9. The groove-direction length of the nozzle plate 10 is narrower than the groove-direction length of the piezoelectric body substrate 2. The lower surface LS is exposed at, at least, an edge portion of the nozzle plate 10.

As illustrated in FIG. 2B, the non-ejection groove 4 penetrates the piezoelectric body substrate 2 from the lower surface LS to the upper surface US, and is extended to the piezoelectric body substrate 2 side of the cover plate 8. The non-ejection groove 4 is formed by cutting the piezoelectric body substrate 2 from the lower surface LS toward the upper surface US using a dicing blade, similarly to the ejection groove 3. Thus, the external form of the dicing blade is transcribed on the cross-sectional surface of the non-ejection groove 4, and an inclined surface 7 of which edge portions are cut downward toward the lower-surface-LS side is formed. The non-ejection groove 4 is extended to the cover plate 8. However, the non-ejection groove 4 has a depth not to be open on the liquid chamber 9. Thus, the liquid in the liquid chamber 9 does not flow into the non-ejection groove 4. In other words, it is not necessary to provide a slit in the liquid chamber 9 for blocking the non-ejection groove 4 while allowing the liquid chamber 9 to communicate with the ejection groove 3.

At least one of the edge portions of an opening portion 14*b* at which the non-ejection groove 4 is open on the lower surface LS of the piezoelectric body substrate 2 is extended to a side surface SS of the piezoelectric body substrate 2. The extended area of the non-ejection groove 4 has a depth from the lower surface LS, which is deeper than ½ of the thickness of the piezoelectric body substrate 2. The individual drive electrodes 13*b* are installed on both of the side surfaces of the non-ejection groove 4, which are on the lower-surface-LS side lower than nearly ½ of the thickness of the piezoelectric body substrate 2. The individual drive electrodes 13*b* on both of the side surfaces are electrically separate from each other. The individual drive electrode 13*b* is extended to an edge portion (the side surface SS). Note that using a dicing blade to cut the non-ejection groove 4 is not an essential requirement for the present invention. Accordingly, both of the edge portions of the non-ejection groove 4 can have vertical surfaces. Furthermore, it is not necessary to extend the non-ejection groove 4 to the cover plate 8 side. In other words, the non-ejection groove 4 can be formed not to penetrate through the piezoelectric body substrate 2.

As illustrated in FIG. 2C, common terminals 16 electrically connected to the common drive electrodes 13*a* are installed on the lower surface LS of the piezoelectric body substrate 2 while individual terminals 17 electrically connected to the individual drive electrodes 13*b* are also installed. The individual terminal 17 electrically connects the two individual drive electrodes 13*b* installed on the side surfaces of the two non-ejection grooves 4. holding the ejection groove 3 therebetween. The side surfaces are on the ejection groove 3 side. The common terminal 16 is installed between the ejection groove 3 and the individual terminal 17 so as to be connected to the common drive electrodes 13*a* installed on both of the side surfaces of the ejection groove 3. The common terminal 16 and the individual terminal 17 are installed in such a way as to be exposed when the nozzle plate 10 is bonded to the lower surface LS of the piezoelectric body substrate 2. The flexible circuit board (not illustrated) including a wiring pattern is connected to the lower surface LS of the piezoelectric body substrate 2 while the wiring pattern is electrically connected to the common terminal 16 and the individual terminal 17 such that a drive signal is supplied from a drive circuit (not illustrated) through the wiring pattern to the common terminal 16 and the individual terminal 17.

The liquid jet head 1 is driven as described below. The liquid supplied to one of the liquid chambers 9 on the cover plate 8 is circulated while flowing into each ejection groove 3, flowing out to the other liquid chamber 9, and being discharged from the other liquid chamber 9. The liquid does not flow into the non-ejection groove 4. Providing a drive signal between the common terminal 16 and the individual terminal 17 thickness-shear deforms both of the sidewalls of the ejection groove 3 and changes the volume of the ejection groove 3, and thus induces a pressure wave in the liquid with which the ejection groove 3 is filled. This ejects the droplets from the nozzle 11.

As described above, each liquid chamber 9 communicates only with the ejection grooves 3. This can simplify the structure of the liquid chamber 9 extremely. The liquid contacts only the common drive electrodes 13*a* and does not contact the individual drive electrodes 13*b* or the wiring between the individual drive electrode 13*b* and the individual terminal 17. Thus, a current does not flow between the common drive electrode 13*a* and the individual drive electrode 13*b* even if a conductive liquid is used. A problem, for example, in that the common drive electrode 13*a* or the individual drive electrode 13*b* is separated through electrolysis does not occur. Note that, although a groove row in which the ejection groove 3 and the non-ejection groove 4 are alternately arranged in the reference direction K is described in the present embodiment, a plurality of groove rows in parallel to each other is formed on a piezoelectric body substrate 2.

(Second Embodiment)

Figure 3:
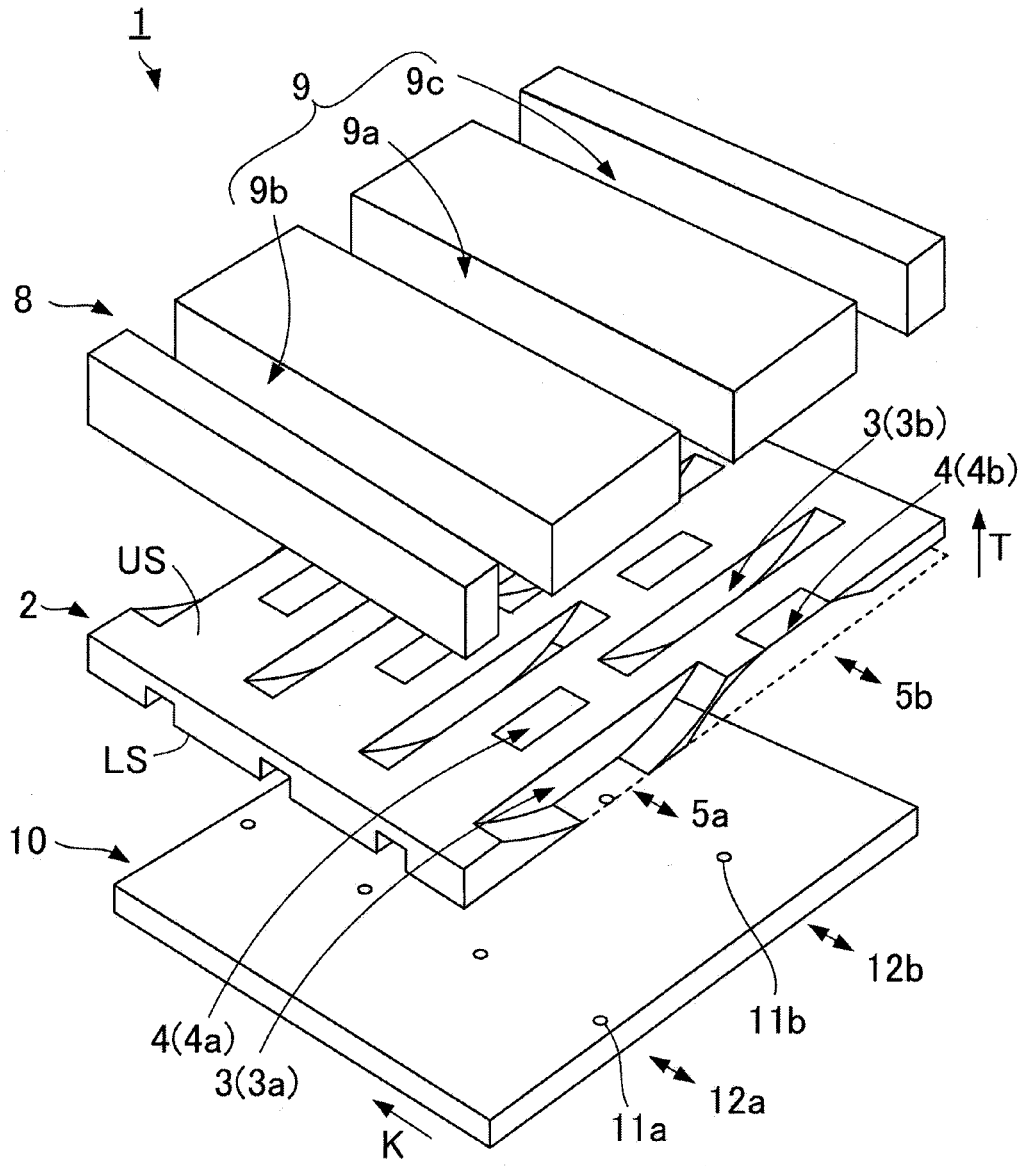
FIG. 3 is a schematic exploded perspective view of a liquid jet head according to a second embodiment of the present invention.
Figure 4A:
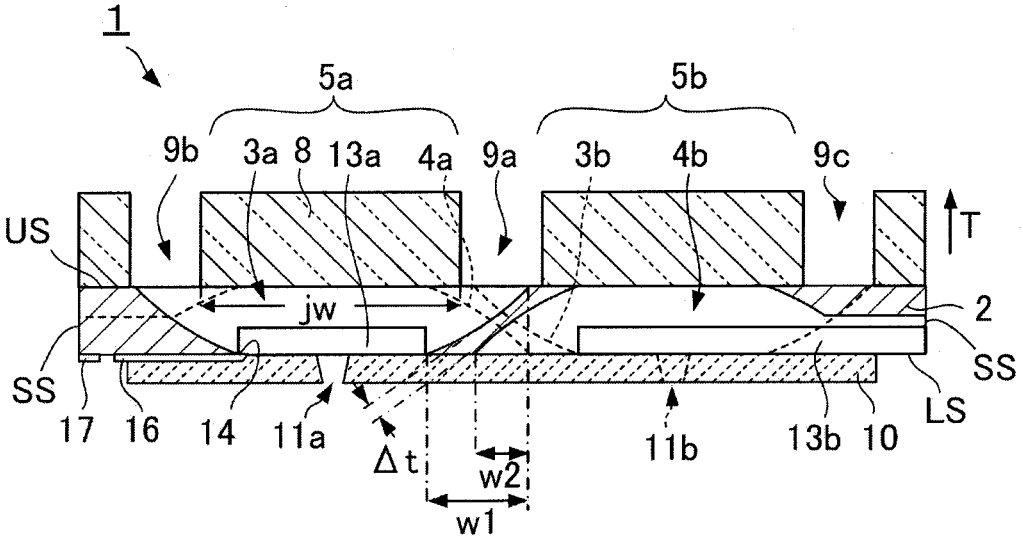
FIGS. 4A and 4B are explanatory views of the liquid jet head according to the second embodiment of the present invention.
Figure 4B:
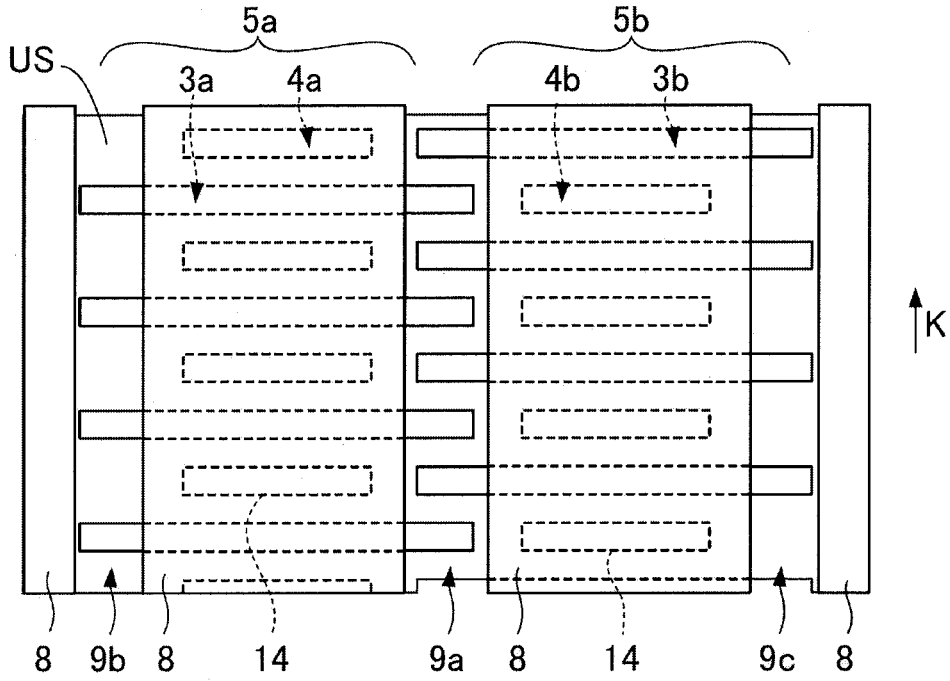
Figure 5:
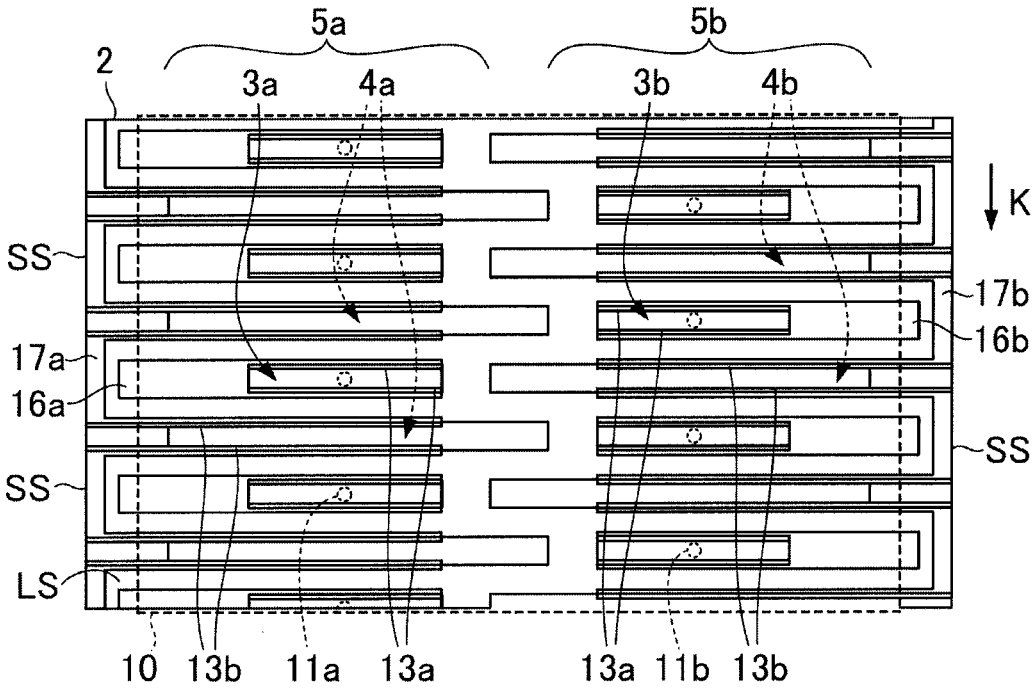
FIG. 5 is an explanatory view of the liquid jet head according to the second embodiment of the present invention.

FIG. 3 is a schematic exploded perspective view of a liquid jet head 1 according to a second embodiment of the present invention. FIGS. 4A and 4B, and FIG. 5 are explanatory views of the liquid jet head according to the second embodiment of the present invention. FIG. 4A is a schematic cross-sectional view of the liquid jet head 1 taken along the groove. FIG. 4B is a schematic partial plan view of the liquid jet head 1 viewed from the normal line direction of the cover plate 8. FIG. 5 is a schematic partial plan view of the lower surface LS on the piezoelectric body substrate 2. Differently from the first embodiment, a plurality of groove rows in which grooves are alternately arranged in the reference direction K is formed. The same components or components having the same function are denoted by the same marks throughout the drawings.

As illustrated in FIG. 3, the liquid jet head 1 includes a piezoelectric body substrate 2 having a first groove row 5*a* and a second groove row 5*b*, a cover plate 8 having a liquid chamber 9, and a nozzle plate 10 having a nozzle 11. The piezoelectric body substrate 2 includes the first groove row 5*a* and second groove row 5*b* in which ejection grooves 3 penetrating from the upper surface US to the lower surface LS and non-ejection grooves 4 open on the lower surface LS are alternately arranged in the reference direction K. The cover plate 8 includes the liquid chambers 9 communicating with a first ejection grooves 3*a* and a second ejection grooves 3*b*, and is bonded on an upper surface US of the piezoelectric body substrate 2. The nozzle plate 10 includes a first nozzle array 12*a* in which first nozzles 11*a* communicating with the first ejection grooves 3*a* are arranged relative to the first groove row 5*a*, and a second nozzle array 12*b* in which second nozzles 11*b* communicating with the second ejection grooves 3*b* are arranged relative to the second groove row 5*b*, and is bonded on a lower surface LS of the piezoelectric body substrate 2.

As illustrated in FIG. 4A, in the first groove row 5*a* and the second groove row 5*b* next to each other, a second-groove-row-side edge portion of the first ejection groove 3*a* included in the first groove row 5*a*, and a first-groove-row-side edge portion of the second non-ejection groove 4*b* included in the second groove row 5*b* are separate from each other while overlapping with each other in a thickness direction T of the piezoelectric body substrate 2. Similarly, in the first groove row 5*a* and the second groove row 5*b* next to each other, which has a first side and a second side, a first-groove-row-side edge portion of the second ejection groove 3*b* included in the second groove row 5*b*, and a second-groove-row-side edge portion of the first non-ejection groove 4*a* included in the first groove row 5*a* are separate from each other while overlapping with each other in the thickness direction T of the piezoelectric body substrate 2. Specifically, the closest approach distance between the second-groove-row-side edge portion of the first ejection groove 3*a* and the first-groove-row-side edge portion of the second non-ejection groove 4*b* is Δt. The second-groove-row-side edge portion of the first ejection groove 3*a* includes an upward-cut inclined surface having a groove-direction length W1. The first-groove-row-side edge portion of the second non-ejection groove 4*b* includes a downward-cut inclined surface having the same length in the groove-direction. The upward-cut inclined surface and the downward-cut inclined surface overlap with each other with a groove-direction length w2 in the thickness direction T. At that case, the closest approach distance Δt is preferable 10 μm or more. When the closest approach distance Δt is less than 10 μm, the first ejection groove 3*a* and the second non-ejection groove 4*b* sometimes communicate with each other through a void in the piezoelectric body substrate 2. To avoid this, the closest approach distance Δt is 10 μm or more. The distance between the first-groove-row-side edge portion of the second ejection groove 3*b* and the second-groove-row-side edge portion of the first non-ejection groove 4*a* is the same.

The liquid chambers 9 include a common liquid chamber 9*a*, and two individual liquid chambers 9*b* and 9*c*. The common liquid chamber 9*a* communicates with the second-groove-row-side edge portions of the first ejection grooves 3*a* included in the first groove row 5*a* and the first-groove-row-side edge portions of the second ejection grooves 3*b* included in the second groove row 5*b*. The individual liquid chamber 9*b* communicates the first-groove-row-side edge portions of the first ejection grooves 3*a* included in the first groove row 5*a*. The individual liquid chamber 9*c* communicates with the second-groove-row-side edge portions of the second ejection groove 3*b* included in the second groove row 5*b*.

As illustrated in FIG. 4B, the first non-ejection groove 4*a* and the second non-ejection groove 4*b* are not open on the upper surface US in the regions of the first ejection groove 3*a* and the second ejection groove 3*b*, which are overlapped with each other in the reference direction K. Thus, it is not necessary to provide a slit in the common liquid chamber 9*a* to allow the common liquid chamber 9*a* to communicate with the first ejection groove 3*a* and the second ejection groove 3*b* and block the first non-ejection groove 4*a* and the second non-ejection groove 4*b* to the common liquid chamber 9*a*. As illustrated in FIG. 4A, the first ejection groove 3*a* and the second non-ejection groove 4*b* are separate from each other while overlapping with each other in the thickness direction T and the second ejection groove 3*b* and the first non-ejection groove 4*a* are separate from each other while overlapping with each other in the thickness direction T. Thus, the liquid flowing into the common liquid chamber 9*a* flows through the first ejection groove 3*a* into the individual liquid chamber 9*b* and flows through the second ejection groove 3*b* into the individual liquid chamber 9*c* without flowing into the first non-ejection groove 4*a* and the second non-ejection groove 4*b*. A part of the liquid flowing into the first ejection groove 3*a* and the second ejection groove 3*b* is ejected from the first nozzle 11*a* and the second nozzle 11*b* that communicate with the first ejection groove 3*a* and the second ejection groove 3*b*, respectively.

As illustrated in FIG. 4A, a second-groove-row-5*b*-side edge portion of the first ejection groove 3*a* and a first-groove-row-5*a*-side edge portion of the second ejection groove 3*b* are preferably located in a region of the opening portion on the piezoelectric body substrate 2 side of the common liquid chamber 9*a*. Similarly, an edge portion of the first ejection groove 3*a*, which is opposite to the second groove row 5*b* side and an edge portion of the second ejection groove 3*b*, which is opposite to the first groove row 5*a* side are preferably located in regions of the opening portion on the piezoelectric body substrate 2 side of the individual liquid chamber 9*b* and the individual liquid chamber 9*c*, respectively. This reduces pooling liquid in the internal regions of the first ejection groove 3*a* and the second ejection groove 3*b*, or the flow paths of the common liquid chamber 9*a* and the individual liquid chambers 9*b* and 9*c*. Thus, air bubbles are not easily accumulated.

Each of the common drive electrode 13*a* and the individual drive electrode 13*b* is formed on the side surface of each of the first ejection groove 3*a*, the second ejection groove 3*b*, the first non-ejection groove 4*a* and the second non-ejection groove 4*b*, which is on the lower surface LS side lower than nearly ½ of the thickness of the piezoelectric body substrate 2. An electrode is not formed the side surface which is on the upper surface US side upper than nearly ½ of the thickness of the piezoelectric body substrate 2. Especially, the common drive electrode 13*a* formed on the side surface of each of the first ejection groove 3*a* and the second ejection groove 3*b* is located at the position of the opening portion 14 open on the lower surface LS of each of the first ejection groove 3*a* and the second ejection groove 3*b* in the groove direction. Specifically, the groove-direction position of the common drive electrode 13*a* nearly corresponds to the groove-direction position of the opening portion 14, or is included in the groove-direction range of the opening portion 14. The individual drive electrodes 13*b* formed on both side surfaces of each of the first non-ejection groove 4*a* and the second non-ejection groove 4*b* are electrically separate from each other, and are extended to the side surface SS of the piezoelectric body substrate 2.

As illustrated in FIG. 5, each of the first non-ejection grooves 4*a* in the first groove row 5*a* is extended to the edge portion (the side surface SS) of the piezoelectric body substrate 2, which is on the opposite side to the second groove row 5*b*. Each of the individual drive electrodes 13*b* formed on the side surfaces of the first non-ejection groove 4*a* is extended to the edge portion (the side surface SS) of the piezoelectric body substrate 2 while being electrically separate. Similarly, each of the second non-ejection grooves 4*b* in the second groove row 5*b* is extended to the edge portion (the side surface SS) of the piezoelectric body substrate 2, which is on the opposite side to the first groove row 5*a*. Each of the individual drive electrodes 13*b* formed on the side surfaces of the second non-ejection groove 4*b* is extended to the edge portion (the side surface SS) of the piezoelectric body substrate 2 while being electrically separate. A first common terminal 16*a* electrically connected to each of the common drive electrodes 13*a* installed on both side surface of the first ejection groove 3*a* and a first individual terminal 17*a* electrically connected to each of the individual drive electrode 13*b* on the first non-ejection groove 4*a* are installed on the lower surface LS of the piezoelectric body substrate 2. Furthermore, a second common terminal 16*b* electrically connected to each of the common drive electrode 13*a* on the second ejection groove 3*b* and a second individual terminal 17*b* electrically connected to each of the individual drive electrode 13*b* on the second non-ejection groove 4*b* are installed on the lower surface LS of the piezoelectric body substrate 2. The first common terminal 16*a* and the first individual terminal 17*a* are installed near the side surface SS on a first side on the lower surface LS of the piezoelectric body substrate 2 while the second common terminal 16*b* and the second individual terminal 17*b* are installed near the side surface SS on a second side. The first common terminal 16*a*, the second common terminal 16*b*, the first individual terminal 17*a*, and the second individual terminal 17*b* are connected to a flexible circuit board (not illustrated) including a wiring pattern such that drive signals are supplied.

More specifically, each of the common drive electrodes 13*a* installed on both side surfaces of each first ejection groove 3*a* is connected to each of the first common terminals 16*a* in the first groove row 5*a*. Two individual drive electrodes 13*b* installed on the first-ejection-groove-3*a*-side side surfaces of the two first non-ejection grooves 4*a* holding a first ejection groove 3*a* therebetween are electrically connected to the first individual terminal 17*a*. The first individual terminals 17*a* are installed on the edge portion on the lower surface LS of the piezoelectric body substrate 2, which is on the first groove row 5*a* side. Each of the first common terminals 16*a* is installed between the first individual terminal 17*a* and the first ejection groove 3*a* on the lower surface LS. The second common terminals 16*b* and the second individual terminals 17*b* are placed in the second groove row 5*b*, similarly to the first common terminals 16*a* and the first individual terminals 17*a*.

In the present embodiment, the first common terminal 16*a*, the second common terminal 16*b*, the first individual terminal 17*a*, and the second individual terminal 17*b* are installed on the lower surface LS of the piezoelectric body substrate 2 so as to be connected to the a flexible circuit board (not illustrated) such that drive signals can be supplied. However, the present invention is not limited to the embodiment. For example, the nozzle plate 10 functions also as the flexible circuit board such that drive signals can be supplied through the nozzle plate 10.

Furthermore, a groove-direction region between the common liquid chamber 9*a* and the individual liquid chamber 9*b* or 9*c*, in which the cover plate 8 is bonded on the upper surface US of the piezoelectric body substrate 2 is a bond region jw (see FIG. 4A). Each of the common drive electrodes 13*a* installed on both side surfaces of each of the first ejection groove 3*a* and the second ejection groove 3*b* preferably corresponds to the bond region jw in the groove direction or is included in the bond region jw. This can effectively induce a pressure wave in the liquid in the first ejection groove 3*a* and the second ejection groove 3*b*.

The liquid jet head 1 is driven as described below. The liquid supplied to the common liquid chamber 9*a* flows into the first ejection groove 3*a* and the second ejection groove 3*b* such that the first ejection groove 3*a* and the second ejection groove 3*b* are filled with the liquid. The liquid circulates while flowing from the first ejection groove 3*a* to the individual liquid chamber 9*b*, and flowing from the second ejection groove 3*b* to the individual liquid chamber 9*c*. The piezoelectric body substrate 2 is polarized in the thickness direction T in advance. For example, when the droplets are ejected from the first nozzle 11*a* communicating with the first ejection groove 3*a*, a drive signal is supplied between the common drive electrode 13*a* and the individual drive electrode 13*b* on both the sidewalls of the first ejection groove 3*a* to thickness-shear deform the sidewalls in order to induce a pressure wave in the liquid in the first ejection groove 3*a*. This ejects the droplets from the first nozzle 11*a* communicating with the first ejection groove 3*a*. More specifically, a drive signal is supplied between the first common terminal 16*a* and the first individual terminal 17*a* to thickness-shear deform both of the sidewalls of the first ejection groove 3*a*. In the practice, the first common terminal 16*a* is fixed at a GND potential level to supply a drive signal to the first individual terminal 17*a*. The droplets are ejected from the second nozzle 11*b* communicating with the second ejection groove 3*b* in the same manner. Note that the liquid can circulate while flowing from the individual liquid chamber 9*b* and 9*c* and flowing out from the common liquid chamber 9*a*.

Note that the first non-ejection groove 4*a* and the second non-ejection groove 4*b* are not filled with the liquid, and each wiring between the first individual terminal 17*a* and the individual drive electrode 13*b* of the first non-ejection groove 4*a* and between the second individual terminal 17*b* and the individual drive electrode 13*b* of the second non-ejection groove 4*b* does not contact the liquid. Thus, even when a conductive liquid is used, drive signals applied between the first individual terminal 17*a* and the first common terminal 16*a* and between the second individual terminal 17*b* and the second common terminal 16*b* do not leak through the liquid. There is not a problem, for example, in that the common drive electrode 13*a*, the individual drive electrode 13*b* or the wiring is separated through electrolysis.

The configuration of the piezoelectric body substrate 2 as described above can reduce the distance between the first groove row 5*a* and the second groove row 5*b*. This can densely form the first ejection groove 3*a* and the second ejection groove 3*b* and can increase the number of bits of the piezoelectric body substrates 2 from a piezoelectric body wafer. This can reduce the cost. For example, if the piezoelectric body substrate 2 is 360 μm in thickness, the groove-direction length w1 of the inclined surface 6 of the ejection groove 3 is about 3.5 mm. The groove-direction length w2 of the overlapping part in which the ejection groove 3 and the non-ejection groove 4 overlap with each other in the thickness direction T while not communicating with each other is about 2 mm. When the thickness is 300 μm, the groove-direction length w1 of the inclined surface 6 is about 3.1 mm while the groove-direction length w2 of the overlapping part is about 1.7 mm. In consideration of the installation of the liquid chamber 9 on the cover plate 8, or the installation of the common terminal 16 and the individual terminal 17 on the piezoelectric body substrate 2, the width of the piezoelectric body substrate 2 decreases by the length of the overlapping part or more. This can increase the number of bits of the piezoelectric body substrates 2 from a piezoelectric body wafer.

The first ejection groove 3*a* and the second ejection groove 3*b* are, installed such that the edge portions overlap with each other in the reference direction K, and such that the first non-ejection groove 4*a* or the second non-ejection groove 4*b* is not open on the overlapping region. Furthermore, the first non-ejection groove 4*a* or the second non-ejection groove 4*b* is neither open on the region of the first ejection groove 3*a*, which is opposite to the second groove row 5*b*, nor onto the region of the second ejection groove 3*b*, which is opposite to the first groove row 5*a*. Thus, it is not necessary to provide a slit in the common liquid chamber 9*a*, the individual liquid chamber 9*b* or 9*c* to allow the liquid chambers 9 to communicate with the first ejection groove 3*a* or the second ejection groove 3*b* and block the first non-ejection groove 4*a* or the second non-ejection groove 4*b* to the liquid chambers 9. This can extremely simplify the configuration of the cover plate 8.

For example, when the nozzle pitch of the first nozzle array 12*a* or the second nozzle array 12*b* which are arranged in the reference direction K is 100 μm, the pitch of the first non-ejection grooves 4*a* or the second non-ejection grooves 4*b* in the reference direction K is also 100 μm. Differently from the present invention, when ejection grooves and non-ejection grooves are open on the upper surface US of a piezoelectric body substrate 2, it is necessary to form the slits in the liquid chambers on the cover plate 8 having a pitch of about 100 μm in the reference direction K. It is necessary to use a material having almost the same thermal expansion coefficient as the piezoelectric body substrate 2 for the cover plate 8. Thus, a ceramics material difficult to be microfabricated, for example, the same PZT ceramics as the piezoelectric body substrate 2 is used. An advanced processing technology is required to provide a slit having a pitch of 100 μm on the ceramics material. In the tendency to narrow the nozzle pitch, a cover plate as described in the present embodiment, which does not require a fine slit, can greatly contribute to reducing the cost for the liquid jet head 1.

(Third Embodiment)

Figure 6:
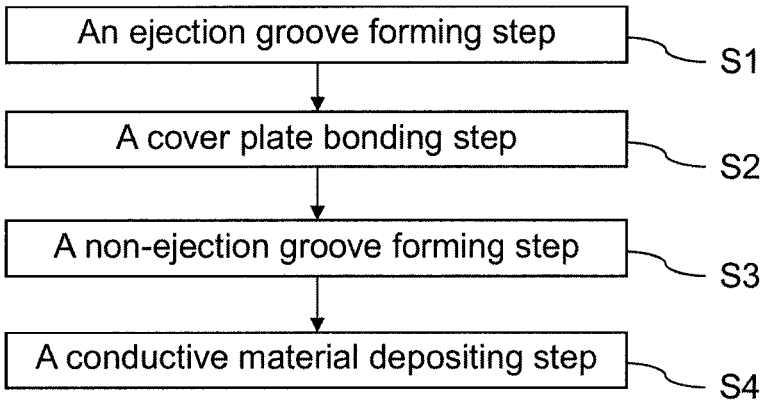
FIG. 6 is a flow sheet of a method of manufacturing a liquid jet head according to a third embodiment of the present invention.

FIG. 6 is a flow sheet of a method of manufacturing a liquid jet head 1 according to a third embodiment of the present invention. FIGS. 7S1 to 7S4 are explanatory views of the method of manufacturing the liquid jet head 1 according to the third embodiment of the present invention. FIG. 7S1 illustrates that an ejection groove 3 is formed on a piezoelectric body substrate 2 using a disk-shaped dicing blade 20. FIG. 7S2 illustrates that a cover plate 8 is bonded on an upper surface US of the piezoelectric body substrate 2. FIG. 7S3 illustrates that a non-ejection groove 4 is formed on a lower surface LS of the piezoelectric body substrate 2 using the disk-shaped dicing blade 20. FIG. 754 illustrates that a conductive material is deposited from the lower surface LS side of the piezoelectric body substrate 2. The embodiment shows a basic method of manufacturing the liquid jet head 1 according to the present invention. The same components or components having the same function are denoted by the same marks throughout the drawings.

As illustrated in FIG. 6, the method of manufacturing the liquid jet head 1 includes an ejection groove forming step S1, a cover plate bonding step S2, a non-ejection groove forming step S3, and a conductive material depositing step S4. The ejection groove forming step S1 to the conductive material depositing step S4 can be performed in order. Alternatively, the non-ejection groove forming step S3 can be performed first followed by the ejection groove forming step S1, the cover plate bonding step S2, and the conductive material depositing step S4.

The method will be described using FIGS. 7S1 to 7S4. The piezoelectric body substrate 2 is cut from the upper surface US side of the piezoelectric body substrate 2 using the disk-shaped dicing blade 20 to form an ejection groove 3 in the ejection groove forming step S1. PZT ceramics can be used as the piezoelectric body substrate 2. The ejection groove 3 can penetrate from the upper surface US to the lower surface LS with the dicing blade 20. Alternatively, the ejection groove 3 does not penetrate in the ejection groove forming step S1, and the lower surface LS of the piezoelectric body substrate 2 can be cut later to allow the ejection groove 3 to penetrate.

Next, in the cover plate bonding step S2, a cover plate 8 on which the liquid chambers 9 are formed is bonded onto the upper surface US of the piezoelectric body substrate 2 such that the liquid chambers 9 communicate with the edge portions of the ejection groove 3. A material having almost the same thermal expansion coefficient as the piezoelectric body substrate 2 is preferably used as the cover plate 8. For example, PZT ceramics or machinable ceramics can be used as the cover plate 8. The liquid chamber 9 includes a straight opening without a slit. The cover plate 8 functions also as a reinforcing plate configured to reinforce the piezoelectric body substrate 2.

Next, in the non-ejection groove forming step S3, the piezoelectric body substrate 2 is cut from the lower surface LS side of the piezoelectric body substrate 2 using the dicing blade 20 to form a plurality of non-ejection grooves 4 in parallel to the groove direction of the ejection groove 3. In that case, the non-ejection groove 4 can be formed so as to penetrate through the piezoelectric body substrate 2, but not to reach the liquid chambers 9 on the cover plate 8. The non-ejection grooves 4 are formed alternately with the ejection grooves 3.

Next, in the conductive material depositing step S4, a conductive material is deposited on the piezoelectric body substrate 2 from the lower surface LS side of the piezoelectric body substrate 2. A metal such as titanium or aluminium can be used as the conductive material. The conductive material is evaporated from the oblique lower side in a direction perpendicular to the groove direction. In such an oblique evaporation method, the conductive material is simultaneously deposited on each side surface of the ejection groove 3 and the non-ejection groove 4 in the depth of nearly ½ the thickness of the piezoelectric body substrate 2. This can form drive electrodes 13 while simultaneously forming common wirings and individual wirings (not illustrated). The conductive material is deposited also on the lower surface LS. Accordingly, installing a photopolymer film on the lower surface LS of the piezoelectric body substrate 2 to form a pattern of the photopolymer film in advance can form an electrode terminal or a wiring on the lower surface LS using a liftoff technique in which the photopolymer film is removed after the conductive material depositing step S4. Alternatively, the pattern of such an electrode terminal or wiring can be formed on the lower surface LS in a photolithography process or an etch process after the conductive material depositing step S4.

When the liquid jet head 1 is manufactured as described above, it is not necessary to provide a slit to block the non-ejection groove 4 because the liquid chambers 9 on the cover plate 8 communicates with the edge portions of the ejection groove 3 while not communicating with the non-ejection groove 4. Furthermore, the common drive electrode 13*a* and the individual drive electrode 13*b* can be formed simultaneously through the opening on the lower surface LS while the conductive material is simultaneously deposited on the lower surface LS. This extremely simplifies the process for forming an electrode.

Note that blocking a part of the opening open on the lower surface LS of the piezoelectric body substrate 2 and depositing an insulating material on the piezoelectric body substrate 2 from the lower surface LS of the piezoelectric body substrate 2 before depositing the conductive material can specify the drive region of the sidewall 18. For example, $SiO_2$ is deposited as the insulating material using an evaporation method. Specifically, a mask is installed at the opening portions of the ejection groove 3 and the non-ejection groove 4 on the lower surface LS to cover the groove-direction range which is to be the drive region of the sidewall 18, and then the insulating material is evaporated from the bottom. As a result, an insulating film is formed on the sidewall outside the drive region. This cuts an unnecessary part of the drive region and thus optimizes the electric efficiency and the deformation of the sidewall 18.

(Fourth Embodiment)

Figure 8:
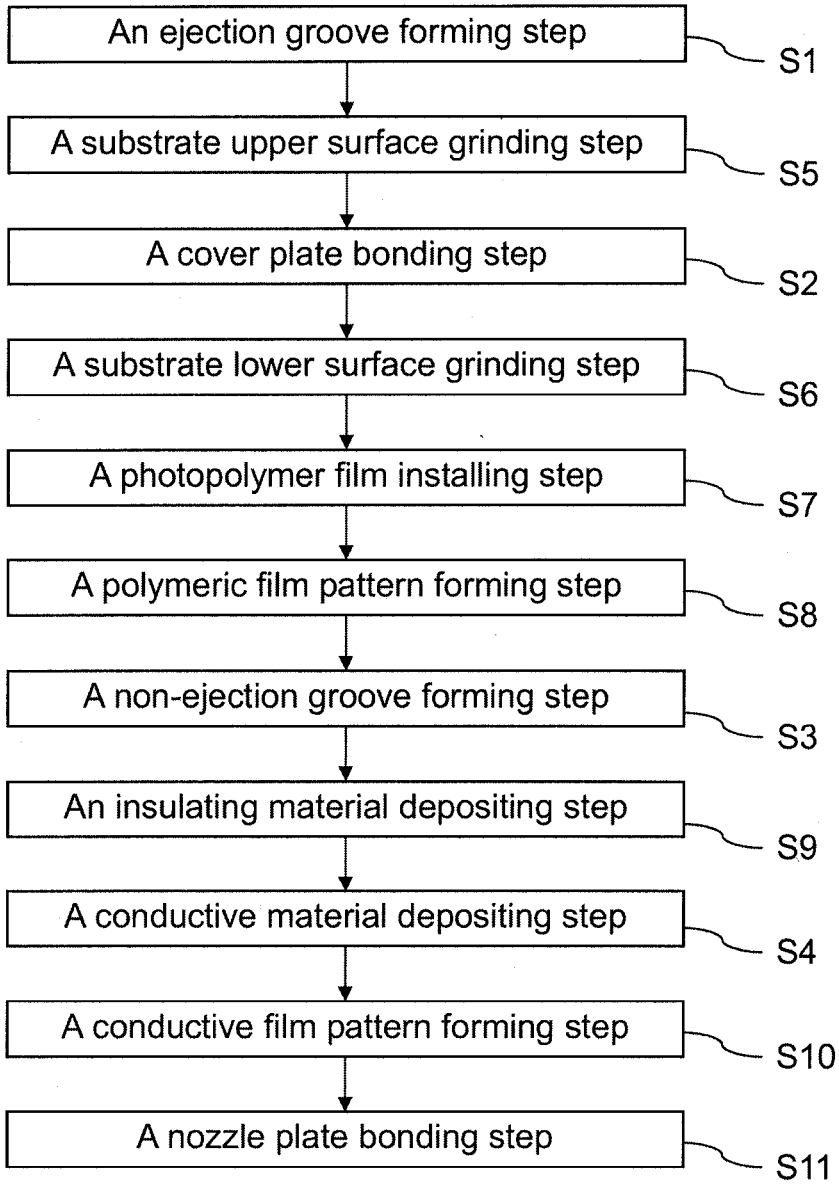
FIG. 8 is a flow sheet of a method of manufacturing a liquid jet head according to a fourth embodiment of the present invention.
Figure 11:
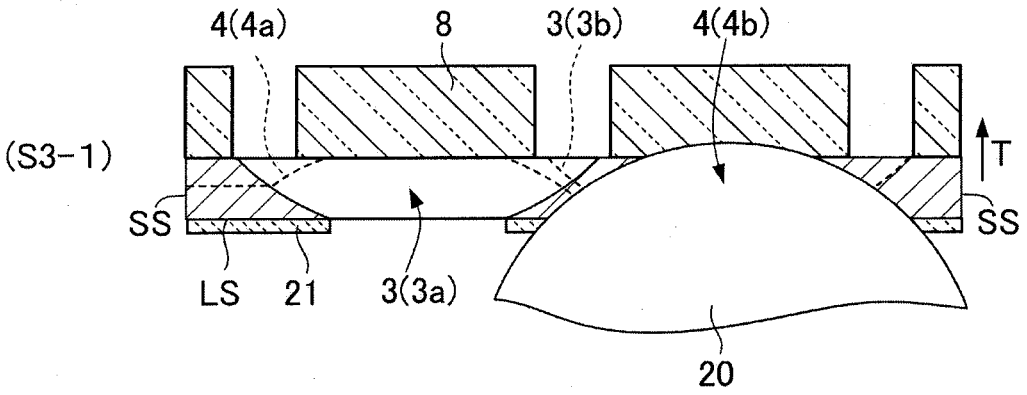
Figure 11:
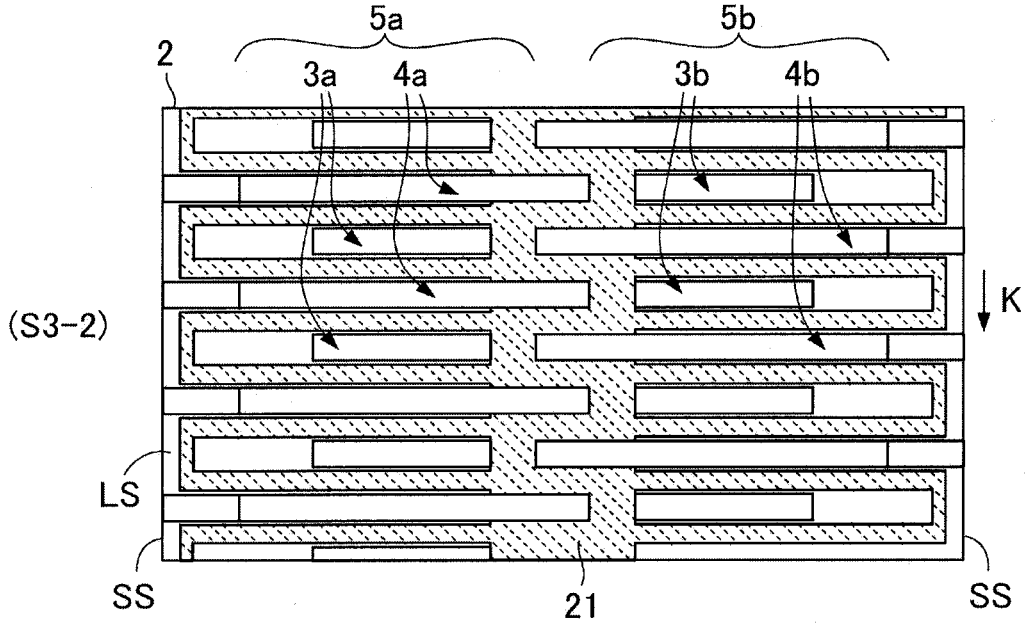
Figure 12:
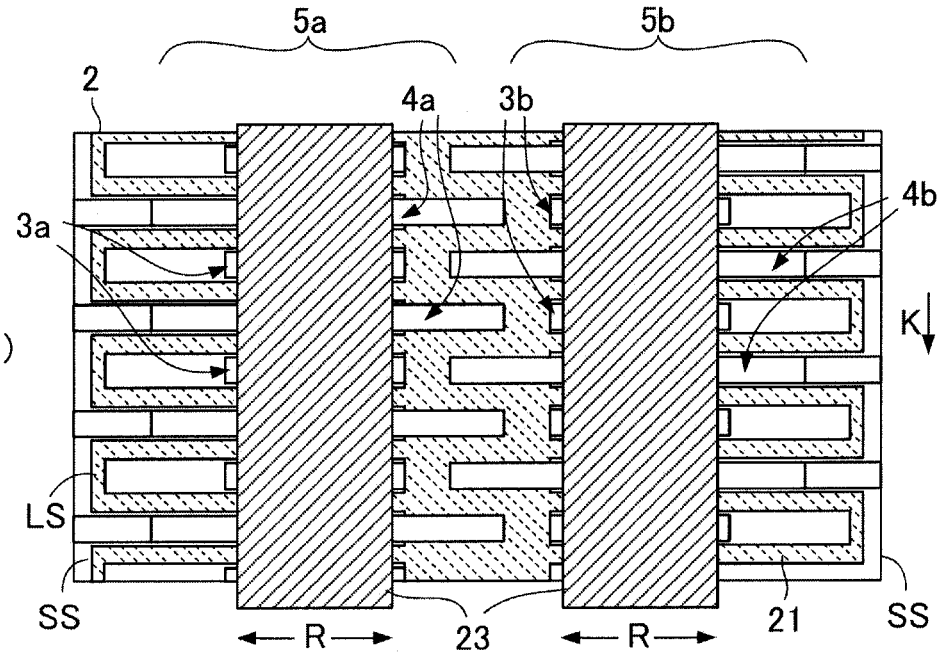
Figure 12:
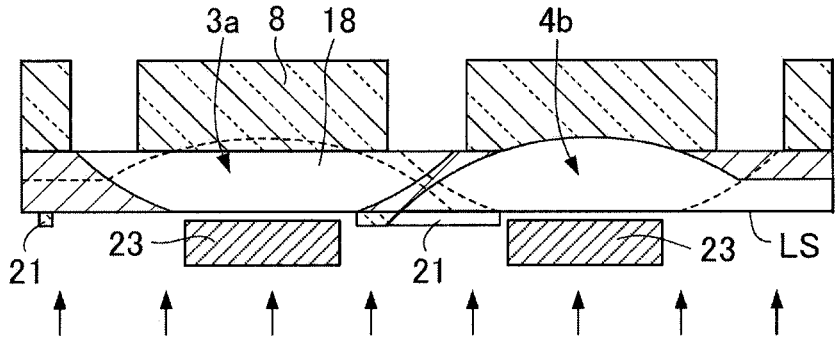
Figure 12:
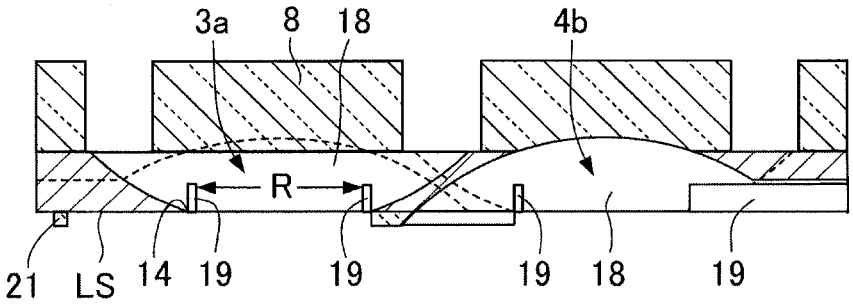
Figure 13:
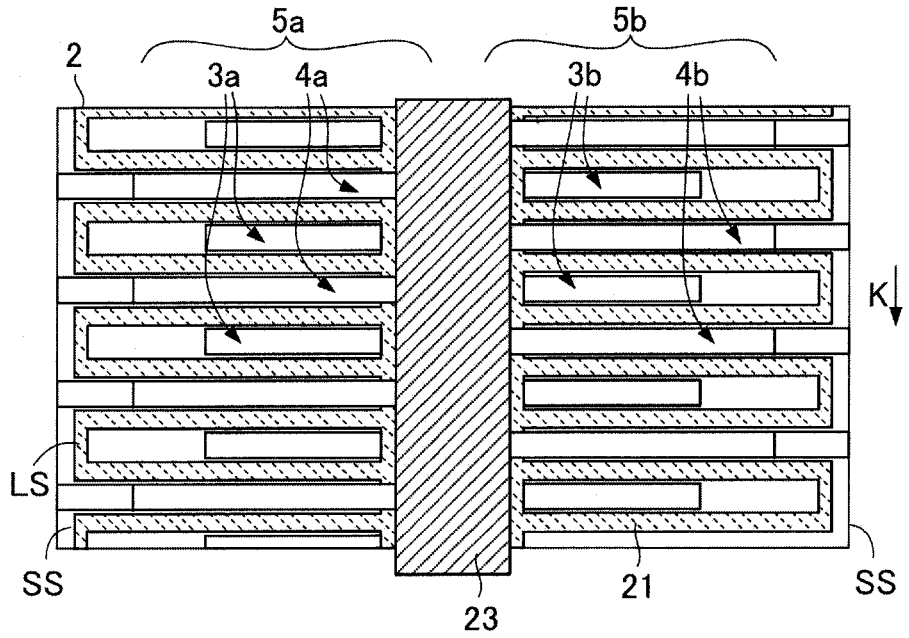
Figure 13:
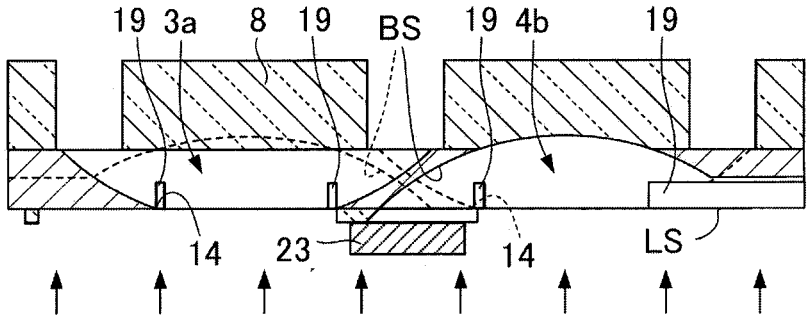
Figure 13:
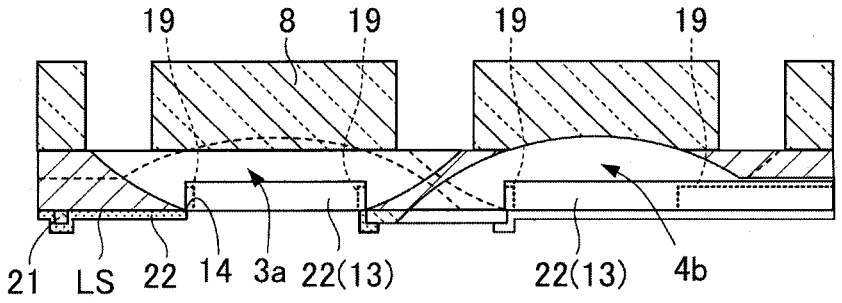
Figure 14:
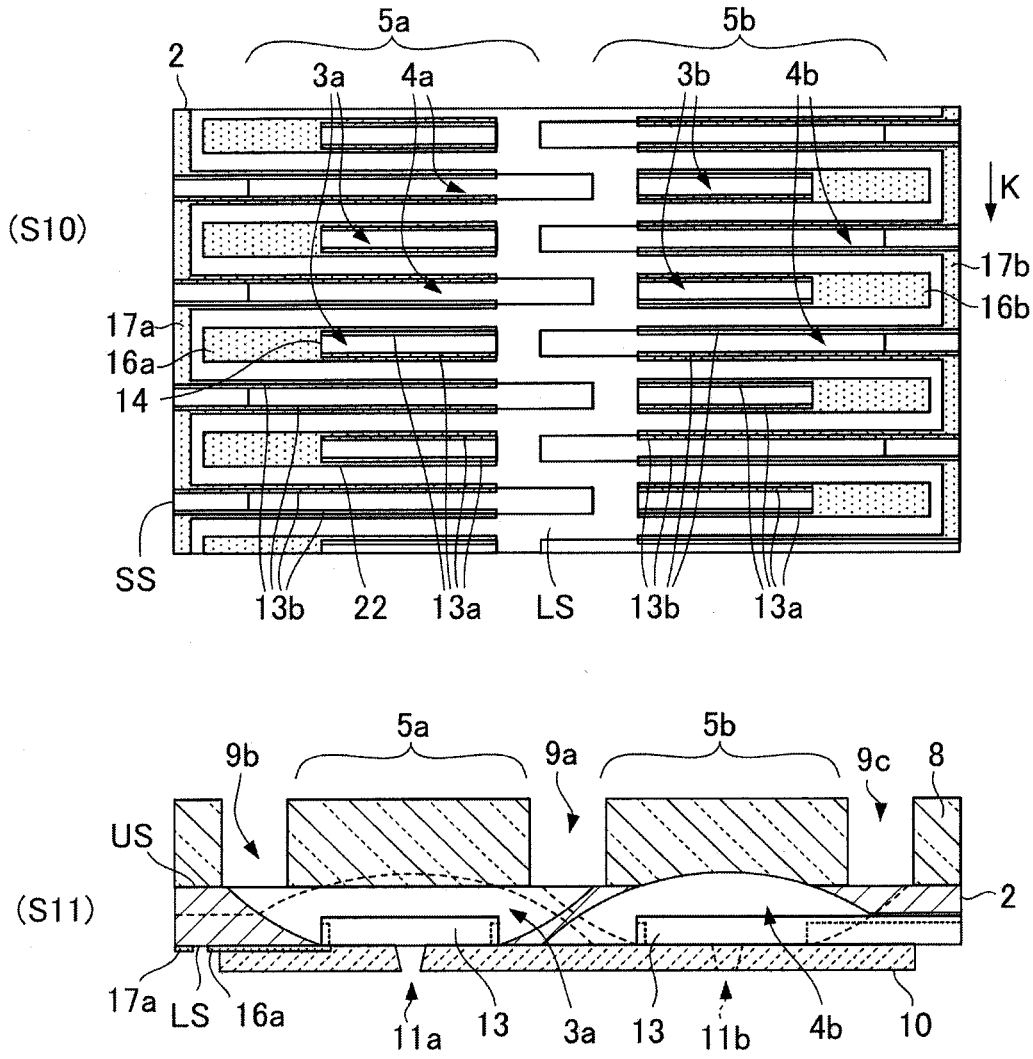

FIGS. 8 to 14S11 are views of a method of manufacturing a liquid jet head 1 according to a fourth embodiment of the present invention. FIG. 8 is a flow sheet of a method of manufacturing the liquid jet head 1. FIGS. 9S1 to 14S11 are each a schematic cross-sectional view or a schematic plan view for describing each step. The same components or components having the same function are denoted by the same marks throughout the drawings.

As illustrated in FIG. 8, the method of manufacturing the liquid jet head 1 according to the present embodiment includes an ejection groove forming step S1 of forming a long and thin ejection groove 3 on the upper surface US of the piezoelectric body substrate 2, a substrate upper surface grinding step S5 for grinding the upper surface US of the piezoelectric body substrate 2 to reduce the thickness of the piezoelectric body substrate 2, a cover plate bonding step S2 for bonding a cover plate 8 onto the ground upper surface US, a substrate lower surface grinding step S6 for grinding the lower-surface-LS side of the piezoelectric body substrate 2 to open the ejection groove 3 onto the lower surface LS, a photopolymer film installing step S7 for installing a photopolymer film on the ground lower surface LS, a polymeric film pattern forming step S8 for patterning the photopolymer film, a non-ejection groove forming step S3 for forming a long and thin non-ejection groove 4 at a part of the lower surface LS on which the pattern of the photopolymer film is formed, which corresponds to the position between the ejection grooves 3 arranged in the reference direction K, an insulating material depositing step S9 for depositing an insulating material on the piezoelectric body substrate 2 from the lower surface LS, a conductive material depositing step S4 for depositing a conductive material on the piezoelectric body substrate 2 from the lower surface LS, a conductive film pattern forming step S10 for patterning a conductive film using a liftoff technique, and a nozzle plate bonding step S11 for bonding a nozzle plate 10 on the lower surface LS side of the piezoelectric body substrate 2.

Hereinafter, each of the steps will be described with reference to FIGS. 9 to 14. A PZT ceramics substrate is used as the piezoelectric body substrate 2. First, in the ejection groove forming step S1 illustrated in FIG. 9S1, the piezoelectric body substrate 2 having a thickness t of 0.8 mm is cut from the upper surface US side using the disk-shaped dicing blade 20 to form a plurality of long and thin first ejection grooves 3*a* at regular intervals in the reference direction K at the rear on the drawing sheet. A plurality of long and thin second ejection grooves 3*b* are formed at regular intervals in the reference direction K at the rear on the drawing sheet while being adjacent to the first ejection grooves 3*a*. The first ejection grooves 3*a* form a first groove row 5*a*. The second ejection grooves 3*b* form a second groove row 5*b*. In that case, a second-groove-row-5*b* side edge portion of the first ejection groove 3*a* included in the first groove row 5*a* and a first-groove-row-5*a*-side edge portion of the second ejection groove 3*b* included in the second groove row 5*b* overlap with each other in the reference direction K (in the rear direction of the drawing sheet). The dicing blade 20, for example, of which radius is 1 inch can be used. The first ejection groove 3*a* and the second ejection groove 3*b* are cut not deeply enough to penetrate the lower surface LS in order to secure the strength of the piezoelectric body substrate 2.

Next, in the substrate upper surface grinding step S5 illustrated in FIG. 9S5, the upper surface US of the piezoelectric body substrate 2 is ground such that the piezoelectric body substrate 2 has a thickness t of 0.5 mm. In that case, the first ejection groove 3*a* and the second ejection groove 3*b* are not open on the lower surface LS of the piezoelectric body substrate 2. Thus, the sidewall is continuous at the parts between the ejection grooves 3 on the lower surface LS of the piezoelectric body substrate 2, and thus the strength is secured.

Next, in the cover plate bonding step S2 illustrated in FIG. 9S2, a cover plate 8 on which a common liquid chamber 9*a* formed at center, and individual liquid chambers 9*b* and 9*c* are formed both sides of the common liquid chamber 9*a* is bonded onto the upper surface US of the piezoelectric body substrate 2 using an adhesive agent while the common liquid chamber 9*a* communicates with the first ejection groove 3*a* and the second ejection groove 3*b*. The common liquid chamber 9*a* does not include a slit inside and includes a long, thin and straight opening in the reference direction K. Each of the individual liquid chambers 9*b* and 9*c* communicates with each of the first ejection groove 3*a* and the second ejection groove 3*b*, and does not include a slit inside and includes a long, thin and straight opening in the reference direction K, similarly to the common liquid chamber 9*a*.

A material having almost the same thermal expansion coefficient as the piezoelectric body substrate 2 is preferably used as the cover plate 8. For example, the same material as the piezoelectric body substrate 2 can be used. Machinable ceramics of which thermal expansion coefficient is approximation to the piezoelectric body substrate 2 can be used. The cover plate 8 does not require a slit with a pitch of several tens to several hundreds μm, and thus can easily be manufactured. The cover plate 8 functions also as a reinforcing plate configured to reinforce the piezoelectric body substrate 2.

Next, in the substrate lower surface grinding step S6 illustrated in, FIG. 9S6, the lower surface LS of the piezoelectric body substrate 2 is ground to reduce the thickness t of the piezoelectric body substrate 2 to 0.3 mm and open the first ejection groove 3*a* and the second ejection groove 3*b* onto the lower surface LS side. Thus, the positions of the first ejection groove 3*a* and the second ejection groove 3*b* can visually be recognized easily from the lower surface LS side.

Figure 7:
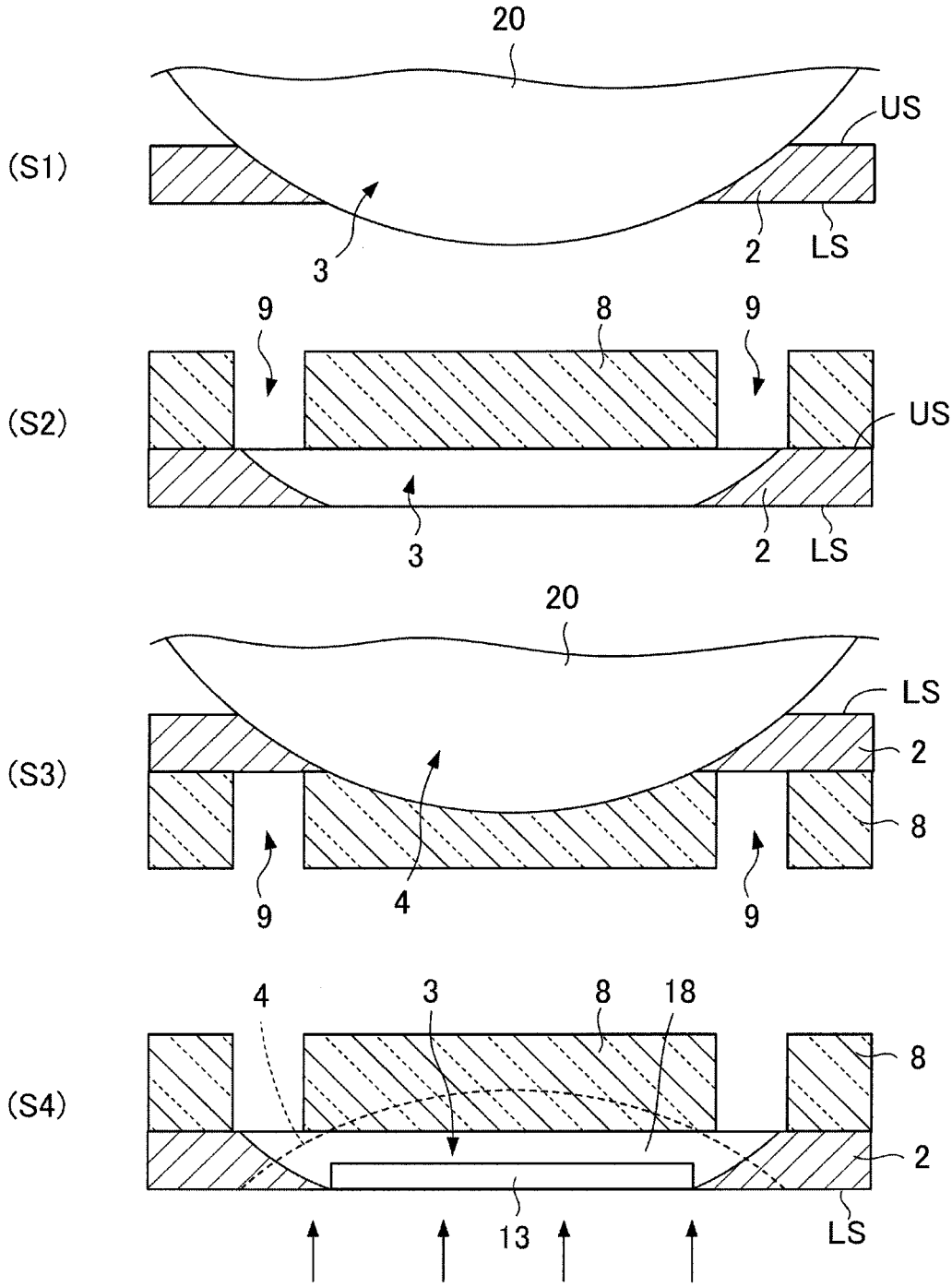

Next, in the photopolymer film installing step S7 illustrated in FIG. 9S7, a photopolymer film 21 is installed on the lower surface LS of the piezoelectric body substrate 2. The sheet-shaped photopolymer film 21 is adhered to the lower surface LS. Next, in the polymeric film pattern forming step S8 illustrated in FIG. 10S8, a lithographic development of the photopolymer film 21 forms the pattern of the photopolymer film 21 shaded with hatching.

Next, in the non-ejection groove forming step S3 illustrated in FIG. 11S3-1, the piezoelectric body substrate 2 is cut from the lower surface LS side opposite to the upper surface US using the disk-shaped dicing blade 20 to form a plurality of long and thin non-ejection grooves 4 in parallel to the groove direction of the ejection groove 3. First non-ejection grooves 4*a* are formed in the first groove row 5*a* while being parallel to and alternately with the first ejection grooves 3*a* in the reference direction K. Second non-ejection grooves 4*b* are formed in the second groove row 5*b* while being parallel to and alternately with the second ejection grooves 3*b* in the reference direction K. The non-ejection groove 4 is cut deeply enough to slightly recess the cover plate 8 such that the upside-down cross-sectional shape of the piezoelectric body substrate 2 is the same as the cross-sectional shape of the ejection groove 3.

Furthermore, in the first groove row 5*a* and the second groove row 5*b* next to each other, a second-groove-row-side edge portion of the first ejection groove 3*a* included in the first groove row 5*a*, and a first-groove-row-side edge portion of the second non-ejection groove 4*b* included in the second groove row 5*b* are separate from each other and overlap with each other in a thickness direction T of the piezoelectric body substrate 2. Similarly, in a first groove row 5*a* and a second groove row 5*b* next to each other, a first-groove-row-side edge portion of the second ejection groove 3*b* included in the second groove row 5*b*, and a second-groove-row-side edge portion of the first non-ejection groove 4*a* included in the first groove row 5*a* are separate from each other and overlap with each other in the thickness direction T of the piezoelectric body substrate 2. An edge portion of the second non-ejection groove 4*b*, which is opposite to the first groove row 5*a*, is extended to the side surface SS while has a thickness less than ½ the thickness of the piezoelectric body substrate 2 on the upper surface US side of the piezoelectric body substrate 2. In FIG. 11S3-1, the dicing blade 20 is pulled down to the lower surface LS side and moved in the side surface SS direction. This extends the second non-ejection groove 4*b* to the side surface SS. An edge portion of the first non-ejection groove 4*a*, which is opposite to the second groove row 5*b* is extended to the side surface SS, similarly to the second non-ejection groove 4*b*.

Each of the closest approach distances between the first ejection groove 3*a* and the second non-ejection groove 4*b* and between the second ejection groove 3*b* and the first non-ejection groove 4*a* is not less than 10 μm. Each of the overlapping widths between the first ejection groove 3*a* and the second non-ejection groove 4*b* and between the second ejection groove 3*b* and the first non-ejection groove 4*a* is nearly 1.7 mm in the groove direction. When the closest approach distance is less than 10 μm, a void in the piezoelectric body substrate 2 sometimes causes the ejection groove 3 to communicate with the non-ejection groove 4. Reducing the space between the first groove row 5*a* and the second groove row 5*b* increases the number of bits of piezoelectric body substrates 2 from a piezoelectric body wafer.

FIG. 11S3-2 is a schematic plan view viewed from the lower surface LS side of the piezoelectric body substrate 2. The first ejection groove 3*a* and the second ejection groove 3*b* are open and, furthermore, the pattern of the photopolymer film 21 is formed on the lower surface LS. Thus, the position of the non-ejection groove 4 is easily adjusted when the non-ejection groove 4 is cut. A wiring or terminal is formed at the region at which the photopolymer film 21 is removed and the lower surface LS is exposed.

Figure 9:
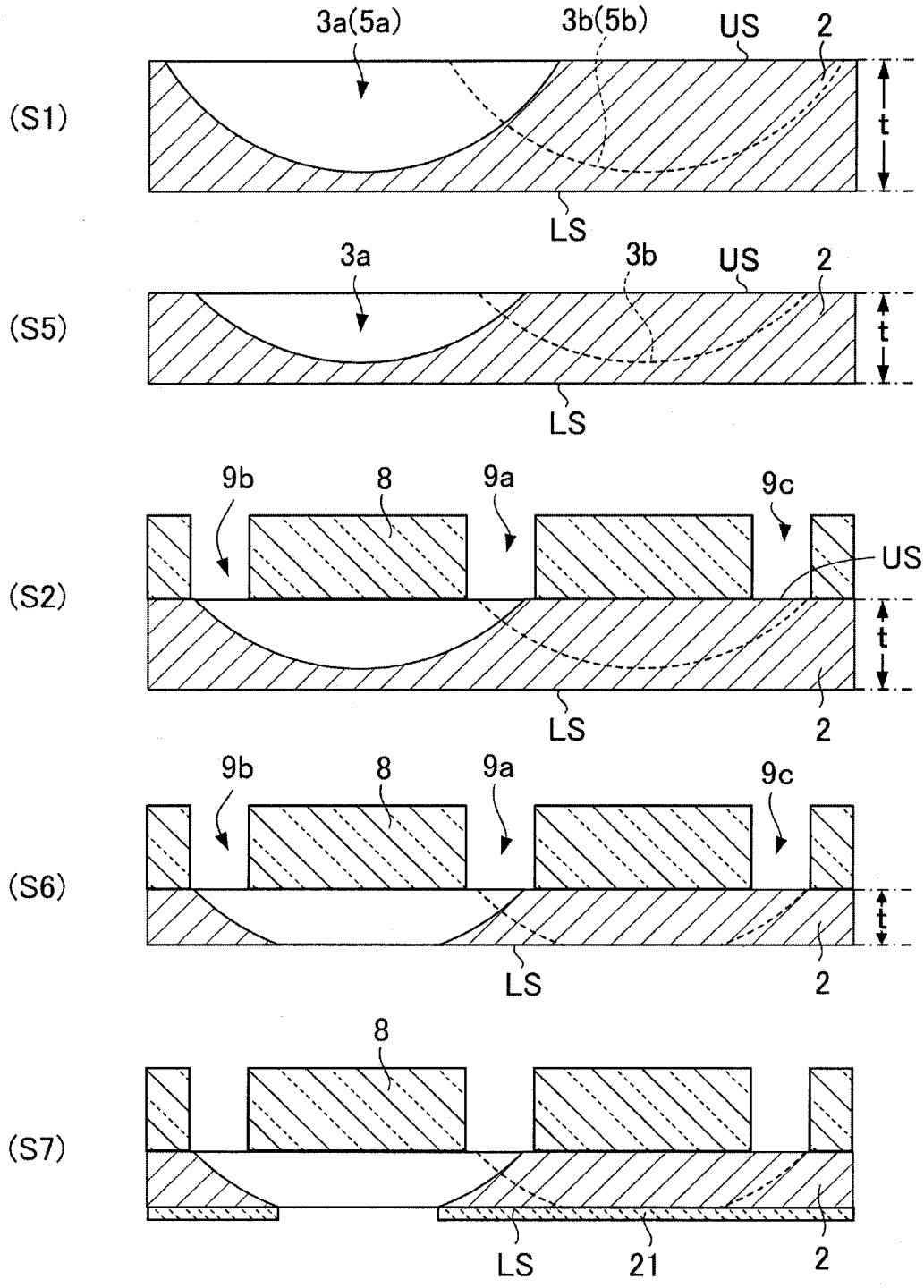

Next, in the insulating material depositing step S9 illustrated in FIGS. 12S9-1 to 12S9-3, an insulating material for specifying the drive region on the sidewall 18, for example, silicon oxide (such as $SiO_2$, SiO, quartz, or silica) is deposited to form an insulating film 19 on the side surfaces of the first ejection groove 3*a* and the second ejection groove 3*b*. FIG. 12S9-1 is a schematic plan view of the lower surface LS of the piezoelectric body substrate 2 on which a mask 23 is installed before the insulating material is deposited, viewed from below the lower surface LS. FIG. 12S9-2 is a schematic cross-sectional view of the evaporation of the insulating material from below the lower surface LS. FIG. 12S9-3 is a schematic cross-sectional view of the insulating film 19 that is formed on each of the side surfaces of the first ejection groove 3*a* and the second non-ejection groove 4*b*.

As illustrated in FIG. 12S9-1, the mask 23 is installed in the range of or near the opening portion 14 of the lower surface LS, in which the first ejection groove 3*a* and the second ejection groove 3*b* are open on the lower surface LS so as to cover a range R that is the drive region. Next, as illustrated in FIG. 12S9-2, an insulating material is deposited in the direction denoted by the upward arrow in an evaporation method, in particular, an oblique evaporation method in the direction inclined in the reference direction K relative to the normal line of the lower surface LS and in the direction inclined in the opposite direction to the reference direction K. This deposits the insulating material on the side surfaces of the first ejection groove 3*a* and the second ejection groove 3*b*, and the side surfaces of the first non-ejection groove 4*a* and the second non-ejection groove 4*b* through the opening portions 14 that are not covered with the mask 23 in order to form the insulating films 19. As illustrated in FIG. 12S9-3, the insulating film 19 is formed to the depth deeper than nearly 1/4, preferably to the depth of nearly ⅓ to nearly ½, of the thickness of the piezoelectric body substrate 2 on each side surface of the first ejection groove 3*a* and the second ejection groove 3. Forming the insulating film 19 to the depth shallower than nearly ¼ of the thickness of the piezoelectric body substrate 2 weakens the effect in specifying the drive region. Forming the insulating film 19 to the depth deeper than nearly ½ of the thickness of the piezoelectric body substrate 2 extends the time for depositing the insulating material and thus reduces the productivity.

Specifying the drive region of the sidewall 18 as described above can cut an unnecessary part of the drive region and can optimize the electric efficiency and the deformation of the sidewall 18. Cutting the first ejection grooves 3*a* and the second ejection grooves 3*b* using the dicing blade easily causes the variation in the shapes of the opening portions 14. This causes the variation in the ranges in which a conductive material is evaporated in the next conductive material depositing step S4. Specifying the drive region by forming the insulating film 19 as the present embodiment can remove the effect of the variation in the ranges in which a conductive material is evaporated. Note that, although the insulating films 19 are also formed on the side surfaces of the first non-ejection groove 4*a* and the second non-ejection groove 4*b* in the present embodiment, the insulating films 19 of the first non-ejection groove 4*a* and the second non-ejection groove 4*b* can be omitted. When the insulating film 19 is not to be deposited on the lower surface LS or near the side surfaces SS of the first non-ejection groove 4*a* and the second non-ejection groove 4*b*, a mask 23 provided with a slit-shaped opening portion outside the region R can be used.

Next, in the conductive material depositing step S4 illustrated in FIGS. 13S4-1 to 13S4-3, a conductive material is deposited on the side surface of the first ejection groove 3*a* and the second ejection groove 3*b* and the side surface of the first non-ejection groove 4*a* and the second non-ejection groove 4*b* from the lower-surface-LS side of the piezoelectric body substrate 2 in order to form a conductive film 22. FIG. 13S4-1 is a schematic plan view of the lower surface LS of the piezoelectric body substrate 2 on which the mask 23 is installed before the conductive material is deposited, viewed from below the lower surface LS. FIG. 13S4-2 is a schematic cross-sectional view of the oblique evaporation of the conductive material from below the lower surface LS to the lower surface LS in the arrow direction. FIG. 13S4-3 is a schematic cross-sectional view of the formed conductive film 22.

As illustrated in FIG. 13S4-1, the mask 23 is installed on the lower surface LS so as to cover the region between the opening portions 14 at which the first ejection grooves 3*a* in the first groove row 5*a* are open on the lower surface LS and the opening portions 14 at which the second ejection groove 3*b* in the second groove row 5*b* are open on the lower surface LS. In other words, the mask 23 is installed on the lower surface LS of the piezoelectric body substrate 2 in order to cover a second-groove-row-5*b*-side edge portion of the first non-ejection groove 4*a* included in the first groove row in the first groove row 5*a* and the second groove row 5*b* next to each other, and a first-groove-row-side edge portion of the second non-ejection groove 4*b* included in the second groove row 5*b*. Specifically, a first-groove-row-5*a*-side edge portion of the mask 23 is installed at the groove-direction position at which the depth of a bottom surface BS of the first non-ejection groove 4*a* from the lower surface LS becomes deeper than the depth of nearly ½ of the thickness of the piezoelectric body substrate 2. Furthermore, a second-groove-row-5*b*-side edge portion of the mask 23 is installed at the groove-direction position at which the depth of a bottom surface BS of the second non-ejection groove 4*b* from the lower surface LS becomes deeper than the depth of nearly ½ of the thickness of the piezoelectric body substrate 2. More generally, the mask 23 is installed at the position between the groove-direction position at which the depth of the bottom surface BS of the first non-ejection groove 4*a* becomes deeper than the upper edge portion of a drive electrode 13 (the individual drive electrode 13*b*) to be formed, and the groove-direction position at which the depth of the bottom surface BS of the second non-ejection groove 4*b* becomes deeper than the upper edge portion of a drive electrode 13 (the individual drive electrode 13*b*) to be formed. This prevents the drive electrodes 13 (the individual drive electrodes 13*b*) formed on both side surfaces of the first non-ejection groove 4*a* from short-circuiting through the bottom surface BS. The same is true in the second non-ejection groove 4*b*.

Next, as illustrated in FIG. 13S4-2, a conductive material is deposited in the direction denoted by the upward arrow in an oblique evaporation method. The conductive material is deposited in the direction inclined in the reference direction K relative to the normal line of the lower surface LS and in the direction inclined in the opposite direction to the reference direction K in the oblique evaporation method. This deposits the conductive material to the depth of nearly ½ of the thickness of the piezoelectric body substrate 2 on the side surfaces of the first ejection groove 3*a* and the second non-ejection groove 4*b* in order to form the drive electrodes 13 as illustrated in FIG. 13S4-3. The conductive material is deposited on the lower surface LS from which the photopolymer film 21 is removed and on the surface of the photopolymer film 21 in order to form the conductive film 22. The conductive material is not deposited on the region at which the mask 23 is installed. A metal material such as titanium or aluminium is used as the conductive material of the first ejection groove 3*a*.

Figure 10:
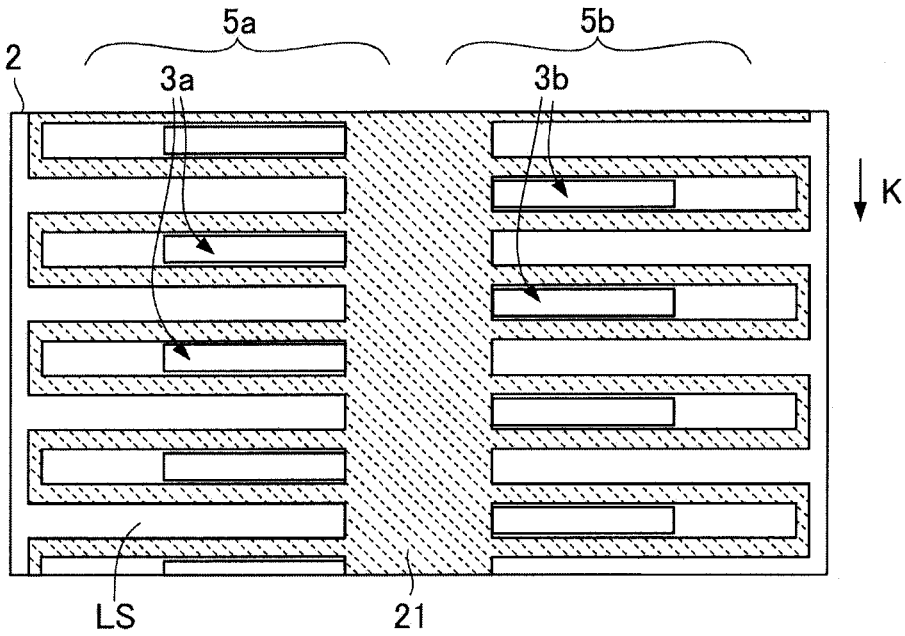
FIG. 10 is a schematic plan view for describing a step of the method of manufacturing the liquid jet head according to the fourth embodiment of the present invention.

FIG. 14S10 is a schematic plan view viewed from the lower surface LS of the piezoelectric body substrate 2. In the conductive film pattern forming step S10 illustrated in FIG. 14S10, the photopolymer film 21 is removed from the lower surface LS in a liftoff technique in order to form the pattern of the conductive film 22. As a result, a first common terminal 16*a* is formed on the lower surface LS on the side-surface-SS side from the opening portion 14 of the first ejection groove 3*a* on the first-groove-row-5*a* side. The first common terminal 16*a* is electrically connected to the common drive electrodes 13*a* on both sidewalls of the first ejection groove 3*a* through the wiring between them. Furthermore, the first individual terminal 17*a* is formed on the side surface SS side from the first common terminal 16*a*, and is electrically connected to the two individual drive electrodes 13*b* on the first-ejection-groove-3*a*side side surfaces of two first non-ejection grooves 4*a* holding a first ejection groove 3*a*. The same is true in the second groove row 5*b*.

Next, in the nozzle plate bonding step S11 illustrated in FIG. 14S11, the nozzle plate 10 is bonded on the lower surface LS of the piezoelectric body substrate 2 with an adhesive agent to allow the nozzles 11*a* and 11*b* formed on the nozzle plate 10 to communicate with the first ejection groove 3*a* and the second ejection groove 3*b*. The nozzles 11*a* and 11*b* are formed at the position corresponding to the first ejection groove 3*a* and the second ejection groove 3*b* in advance and the position of the nozzle plate 10 is adjusted. Then, the nozzle plate 10 is bonded on the lower surface LS. The nozzles 11*a* and 11*b* communicate with the first ejection groove 3*a* and the second ejection groove 3*b*, respectively. The positions of the nozzles 11*a* and 11*b* can easily be adjusted because the first ejection groove 3*a* and the second ejection groove 3*b* are open on the lower surface LS. Alternatively, after the nozzle plate 10 is bonded onto the lower surface LS of the piezoelectric body substrate 2, the nozzles 11*a* and 11*b* are opened. Then, the nozzles 11*a* and 11*b* can communicate with the first ejection groove 3*a* and the second ejection groove 3*b*, respectively. At that time, the nozzle plate 10 is formed to be narrower than the piezoelectric body substrate 2 in width in order to expose the first common terminal 16*a*, the second common terminal 16*b*, the first individual terminal 17*a*, and the second individual terminal 17*b*.

Forming the liquid jet head 1 as described above can drastically reduce the groove-direction width of the piezoelectric body substrate 2. For example, in a conventional liquid jet head, when the first groove row 5*a* and the second groove row 5*b* are formed in parallel while the edge portion of the first ejection groove 3*a* (the second ejection groove 3*b*) does not overlap with the edge portion of the second non-ejection groove 4*b* (the first non-ejection groove 4*a*), this requires the piezoelectric body substrate 2 with the groove-direction width of 29 mm. In comparison, when the edge portion of the first ejection groove 3*a* (the second ejection groove 3*b*) overlaps with the edge portion of the second non-ejection groove 4*b* (the first non-ejection groove 4*a*) as in the present invention, this can reduce the groove-direction width of the piezoelectric body substrate 2 to 18 mm. A conventional liquid jet head requires the same number of fine slits in the liquid chamber 9 of the cover plate 8 as the number of ejection grooves 3. However, the present invention does not require a fine slit. This can especially meet the densification of the nozzle pitch.

Note that the above-mentioned manufacturing method is an example of the present invention. For example, the non-ejection groove forming step S2 can be followed by the ejection groove forming step S1. The liquid jet head 1 that includes two rows of the first groove row 5*a* and the second groove row 5*b* has been described as an example in the embodiments. However, the present invention is not limited to the two rows. For example, a liquid jet head 1 that includes three or four rows can be formed according to the present invention. Increasing the number of rows increase the number of bits from a piezoelectric body wafer. This can reduce the cost of manufacturing.

(Fifth Embodiment)

Figure 15:
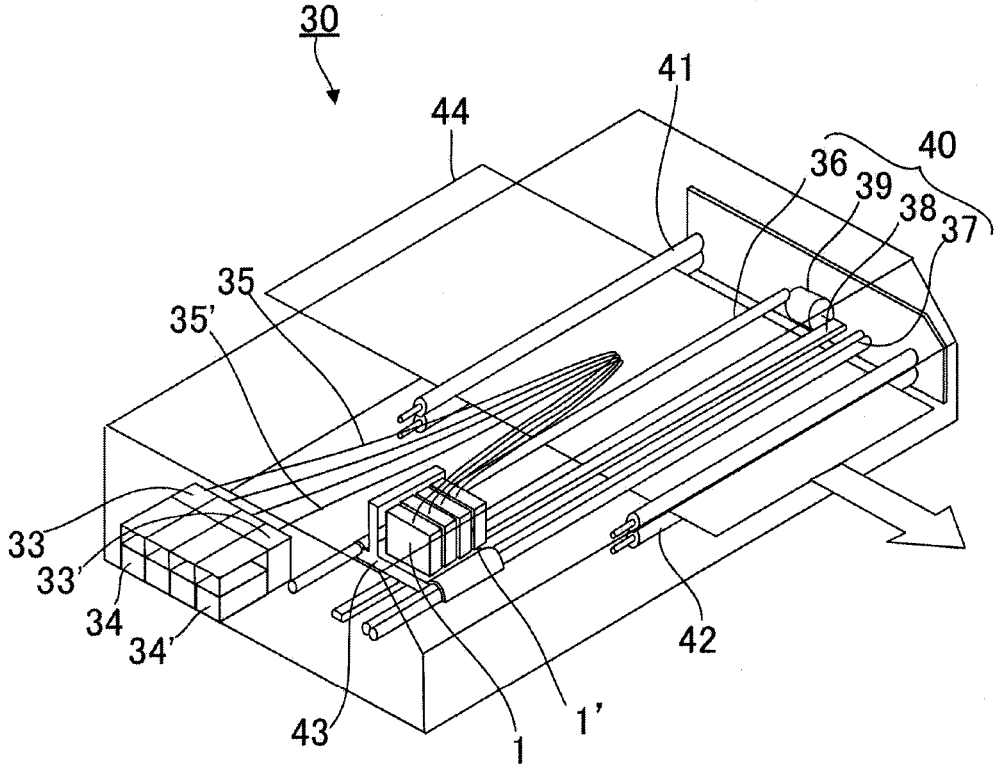
FIG. 15 is a schematic perspective view of a liquid jet apparatus according to a fifth embodiment of the present invention.
Figure 16:
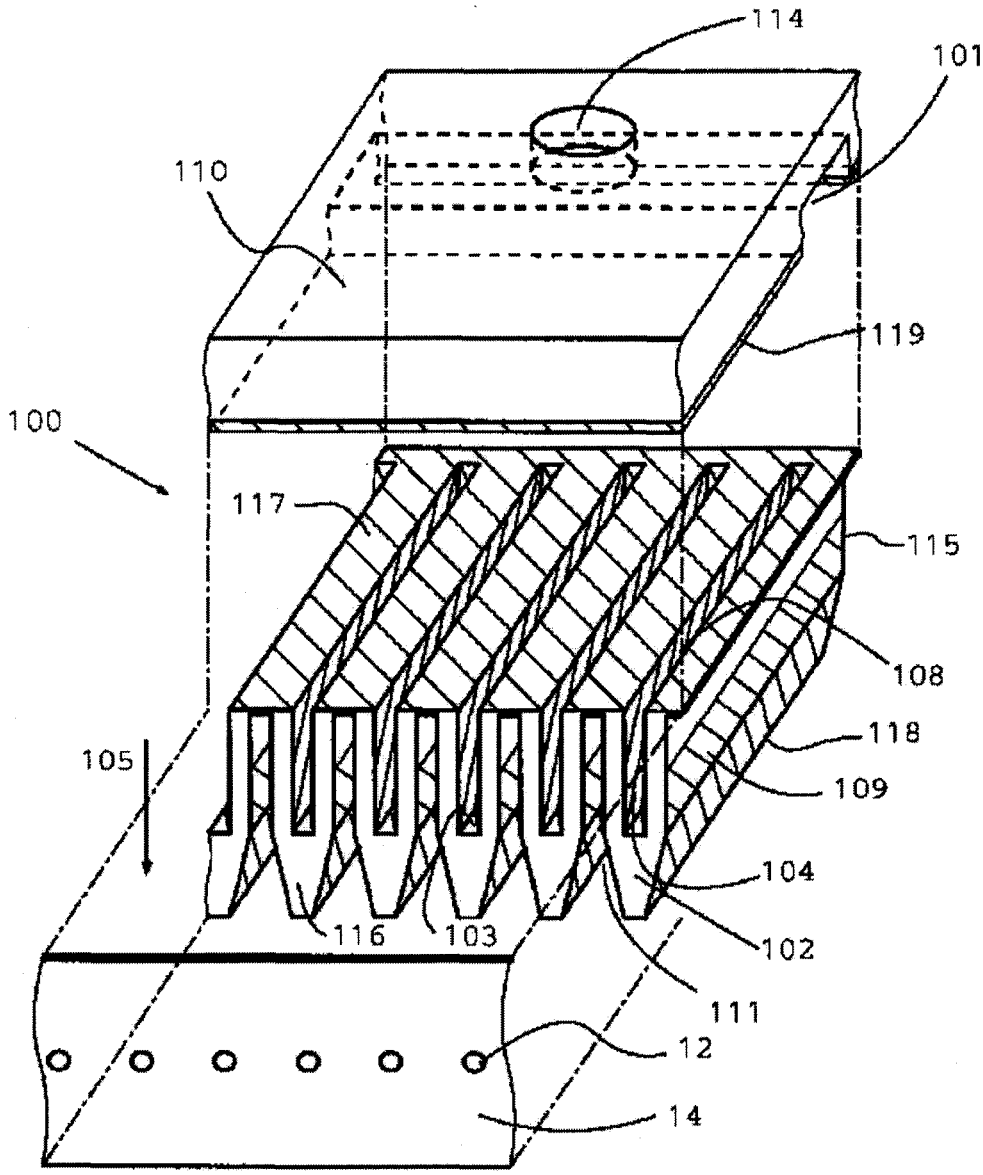
Fig.16 Prior art
FIG. 16 is an exploded perspective view of a well-known conventional liquid jet head.

FIG. 15 is a schematic perspective view of a liquid jet apparatus 30 according to the fifth embodiment of the present invention. The liquid jet apparatus 30 is provided with a movement mechanism 40 which reciprocates liquid jet heads 1 and 1', flow path sections 35 and 35' which respectively supply liquid to the liquid jet heads 1 and 1' and discharge liquid from the liquid jet heads 1 and 1', and liquid pumps 33 and 33' and liquid tanks 34 and 34' which respectively communicate with the flow path sections 35 and 35'. Each of the liquid jet heads 1 and 1' includes a plurality of groove rows. A second-groove-row-side edge portion of the ejection groove included in a first groove row and a first-groove-row-side edge portion of the non-ejection groove included in the second groove row are separate from each other and overlap with each other in the direction of the thickness of the piezoelectric body substrate. As each of the liquid jet heads 1 and 1', any one of the liquid jet heads of the first to fourth embodiments is used.

The liquid jet apparatus 30 is provided with a pair of conveyance units 41 and 42 which conveys a recording medium 44 such as paper in a main scanning direction, the liquid jet heads 1 and 1' each of which ejects liquid onto the recording medium 44, a carriage unit 43 on which the liquid jet heads 1 and 1' are loaded, the liquid pumps 33 and 33' which respectively supply liquid stored in the'liquid tanks 34 and 34' to the flow path sections 35 and 35' by pressing, and the movement mechanism 40 which moves the liquid jet heads 1 and 1' in a sub-scanning direction that is perpendicular to the main scanning direction. A control unit (not illustrated) controls the liquid jet heads 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44, which is sandwiched between the rollers, in the main scanning direction. The movement mechanism 40 is provided with a pair of guide rails 36 and 37 each of which extends in the sub-scanning direction, the carriage unit 43 which can slide along the pair of guide rails 36 and 37, an endless belt 38 to which the carriage unit 43 is coupled to move the carriage unit 43 in the sub-scanning direction, and a motor 39 which revolves the endless belt 38 via a pulley (not illustrated).

The carriage unit 43 loads the plurality of liquid jet heads 1 and 1' thereon. The liquid jet heads 1 and 1' eject, for example, liquid droplets of four colors including yellow, magenta, cyan, and black. Each of the liquid tanks 34 and 34' stores liquid of corresponding color, and supplies the stored liquid to each of the liquid jet heads 1 and 1' through each of the liquid pumps 33 and 33' and each of the flow path sections 35 and 35'. Each of the liquid jet heads 1 and 1' ejects liquid droplets of corresponding color in response to a driving signal. Any patterns can be recorded on the recording medium 44 by controlling the timing of ejecting liquid from the liquid jet heads 1 and 1', the rotation of the motor 39 for driving the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium.

What is claimed is:

1. A liquid jet head comprising:

a piezoelectric body substrate on which ejection grooves penetrating from an upper surface to a lower surface and non-ejection grooves open on the lower surface are alternately arranged in a reference direction and form a groove row;

a cover plate that includes a liquid chamber communicating with the ejection grooves and that is bonded on the upper surface of the piezoelectric body substrate; and a nozzle plate that includes nozzles communicating with the ejection grooves and that is bonded on the lower surface of the piezoelectric body substrate, wherein common drive electrodes are installed on side surfaces of the ejection grooves at locations lower than nearly ½ of a depth of the ejection grooves, and individual drive electrodes are installed on side surfaces of the non-ejection grooves at locations lower than nearly ½ of a depth of the non-ejection grooves.

2. The liquid jet head according to claim 1, wherein common terminals electrically connected to the common drive electrodes and individual terminals electrically connected to the individual drive electrodes are installed on the lower surface of the piezoelectric body substrate.

3. The liquid jet head according to claim 2, wherein each individual terminal electrically connects two individual drive electrodes installed on ejection-groove-side side surfaces of two non-ejection grooves located on opposite sides of the ejection groove.

4. The liquid jet head according to claim 2, further comprising:

a flexible circuit board including a wiring pattern, wherein the flexible circuit board is connected to the lower surface of the piezoelectric body substrate while the wiring pattern is electrically connected to the common terminals and the individual terminals.

5. The liquid jet head according to claim 2, wherein the ejection grooves have inclined portions at opposite ends thereof, the inclined portions being inclined outward from the lower surface to the upper surface of the piezoelectric body substrate, and wherein the common terminals are installed on the lower surface of the piezoelectric body substrate directly beneath the inclined portions at one end of the ejection grooves.

6. The liquid jet head according to claim 1, wherein a groove-direction width of each common drive electrode is nearly equal to or narrower than a groove-direction width of an opening portion at which the ejection groove is open on the lower surface of the piezoelectric body substrate.

7. The liquid jet head according to claim 1, wherein at least one of two opposite groove-direction edge portions of an opening portion at which the non-ejection groove is open on the lower surface of the piezoelectric body substrate is extended to a side surface of the piezoelectric body substrate.

8. The liquid jet head according to claim 1, wherein each non-ejection groove is open at a region that is on the upper surface of the piezoelectric body substrate and that does not communicate with the liquid chamber.

9. The liquid jet head according to claim 1, wherein the piezoelectric body substrate includes a plurality of the groove rows arranged in parallel in a reference direction, and a second-groove-row-side edge portion of the ejection groove included in a first groove row among the groove rows next to each other and a first-groove-row-side edge portion of the non-ejection groove included in a second groove row are separate from each other while overlapping with each other in a thickness direction of the piezoelectric body substrate.

10. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

11. A liquid jet head comprising:

a piezoelectric substrate having opposed upper and lower surfaces, ejection grooves extending in a depth direction completely through the piezoelectric substrate from the upper surface to the lower surface, and non-ejection grooves extending in a depth direction at least partly through the piezoelectric substrate from the lower surface, the ejection grooves and the non-ejection grooves having open bottoms that open on the lower surface of the piezoelectric substrate and being alternately arranged to form a groove row;

a cover plate attached to the upper surface of the piezoelectric substrate and having a liquid chamber communicating with the ejection grooves;

a nozzle plate attached to the lower surface of the piezoelectric substrate to cover the open bottoms of the ejection grooves and the non-ejection grooves and having nozzles communicating with respective ejection grooves;

common drive electrodes extending in a longitudinal directon along side surfaces of the ejection grooves and extending in the depth direction between the bottoms to near mid-portions of the ejection grooves; and individual drive electrodes extending in a longitudinal direction along side surfaces of the non-ejection grooves and extending in the depth direction between the bottoms to near mid-portions of the non-ejection grooves.

12. A liquid jet head according to claim 11; further including common terminals electrically connected to the common drive electrodes and being disposed on the lower surface of the piezoelectric substrate, and individual terminals electrically connected to the individual drive electrodes and being disposed on the lower surface of the piezoelectric substrate.

13. A liquid jet head according to claim 12; wherein the ejection grooves have inclined portions at one end portion thereof, the inclined portions being inclined outward from the lower surface to the upper surface of the piezoelectric substrate, and wherein the common terminals are disposed on the lower surface of the piezoelectric substrate such that major portions of the common terminals are situated directly beneath respective inclined portions.

14. A liquid jet head according to claim 13; wherein the ejection grooves have inclined portions at opposite end portions thereof.

15. A liquid jet head according to claim 13; wherein the common terminals are situated in their entirety directly beneath respective inclined portions.

16. A liquid jet head according to claim 13; wherein the individual drive electrodes extend in the longitudinal direction to a side surface of the piezoelectric substrate, each two adjacent individual drive electrodes that are on opposiste sides of an ejection groove being connected to one of the individual terminals.

17. A liquid jet head according to claim 13; further comprising a flexible circuit board having a wiring pattern, the flexible circuit board being connected to the lower surface of the piezoelectric substrate and the wiring pattern being electrically connected to the common terminals and the individual terminals.

18. A liquid jet head according to claim 13; wherein the dimension of the common drive electrodes in the longitudinal direction is equal to or less than the dimension of the open bottoms of the ejection grooves in the longitudinal direction.

19. A liquid jet head according to claim 11; wherein the individual drive electrodes extend in the longitudinal direction to a side surface of the piezoelectric substrate, each two adjacent individual drive electrodes that are on opposiste sides of an ejection groove being connected to one of the individual terminals.

20. A liquid jet head according to claim 11; wherein the dimension of the common drive electrodes in the longitudinal direction is equal to or less than the dimension of the open bottoms of the ejection grooves in the longitudinal direction.

* * * * *